US010556739B2

(12) United States Patent
LiVigni et al.

(10) Patent No.: US 10,556,739 B2
(45) Date of Patent: Feb. 11, 2020

(54) RIGID PACK FOR TOBACCO ARTICLES WITH LID AND PROVIDED, AT THE BOTTOM, WITH A PULL-OUT CONTAINER

(71) Applicant: G.D SOCIETA' PER AZIONI, Bologna (IT)

(72) Inventors: Angelo LiVigni, Bologna (IT); Alver Tacchi, Bologna (IT); Luca Federici, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 0 days.

(21) Appl. No.: 16/301,541

(22) PCT Filed: May 19, 2017

(86) PCT No.: PCT/IB2017/052964
§ 371 (c)(1),
(2) Date: Nov. 14, 2018

(87) PCT Pub. No.: WO2017/199212
PCT Pub. Date: Nov. 23, 2017

(65) Prior Publication Data

US 2019/0202626 A1 Jul. 4, 2019

(30) Foreign Application Priority Data

May 20, 2016 (IT) ..... 102016000052379

(51) Int. Cl.
*B65D 85/10* (2006.01)

(52) U.S. Cl.
CPC ..... *B65D 85/1045* (2013.01); *B65D 85/1081* (2013.01)

(58) Field of Classification Search
CPC .. B65D 85/1045; B65D 85/1081; A24F 15/18
(Continued)

(56) References Cited

U.S. PATENT DOCUMENTS 2,585,923 A * 2/1952 Epler ..... A24F 15/18 206/246
2,811,247 A * 10/1957 Stevenson ..... A24F 15/18 206/90

(Continued)

FOREIGN PATENT DOCUMENTS

FR 2495444 A1 6/1982
GB 1036133 A 7/1966

(Continued)

OTHER PUBLICATIONS

International Application No. PCT/IB2017/052964, International Search Report and Written Opinion, dated Aug. 24, 2017.

(Continued)

*Primary Examiner* — Luan K Bui
(74) *Attorney, Agent, or Firm* — Marshall, Gerstein & Borun LLP

(57) ABSTRACT

A rigid pack for tobacco articles having: at least one wrap of parallelepiped shape, which encloses a group of tobacco articles; a rigid container whose inner volume is divided into a top chamber, which houses the wrap and a bottom chamber which is available; a rigid lid hinged to the container; a rigid collar, which is folded in a "U"-shape, and is arranged inside the container; a drawer, which is arranged in the area of the bottom chamber, is cup-shaped and has a sliding opening by means of linear movement between a closed position in which the drawer is completely arranged inside the container and an open position in which the drawer is partially pulled out of the container and projects outwards from the container; and a limit stop device, which fulfils the function of stopping the outward movement of the drawer from the container in a maximum open position, namely of preventing the drawer from being completely pulled out of the
(Continued)

container by setting a maximum limit for the pull-out movement of the drawer from the container.

11 Claims, 17 Drawing Sheets

(58) Field of Classification Search
USPC ..... 206/86, 242, 246, 265, 268, 271, 273
See application file for complete search history.

(56) References Cited

U.S. PATENT DOCUMENTS 3,388,706 A * 6/1968 Muirheid ..... A24F 15/18 131/238
3,915,295 A * 10/1975 Morrison ..... B65D 85/109 206/91
5,368,155 A * 11/1994 Ewen ..... B65D 85/1009 131/236
5,480,025 A 1/1996 Draucker et al.
7,114,504 B2 * 10/2006 Fox ..... A24F 15/18 131/238
2005/0236282 A1 * 10/2005 Huska ..... A24F 13/18 206/246
2005/0241966 A1 * 11/2005 Giannini ..... B65D 5/38 206/242
2006/0266662 A1 * 11/2006 Sugiharto ..... B65D 85/109 206/86

FOREIGN PATENT DOCUMENTS

WO WO-2014/087082 A1 6/2014
WO WO-2016/166692 A1 10/2016

OTHER PUBLICATIONS

International Application No. PCT/IB2017/052964, International Preliminary Report on Patentability, dated Apr. 17, 2018.
European Patent Application No. 1773675838, Communication Pursuant to Article 9493) EPC, dated Dec. 12, 2019.

* cited by examiner

RIGID PACK FOR TOBACCO ARTICLES WITH LID AND PROVIDED, AT THE BOTTOM, WITH A PULL-OUT CONTAINER

CROSS-REFERENCE TO RELATED APPLICATIONS

This is the U.S. national phase of International Application No. PCT/IB2017/052964, filed May 19, 2017, which claims the benefit of Italian Patent Application No. 102016000052379, filed May 20, 2016.

TECHNICAL FIELD

The present invention relates to a rigid pack for tobacco articles with lid and provided, at the bottom, with a pull-out container.

The present invention finds advantageous application to a rigid pack for new-generation smoke-free cigarettes (also called "HeatStick"), to which the following description will make explicit reference without losing any generality.

PRIOR ART

New-generation smoke-free cigarettes (also called "HeatStick"), have recently been introduced on the market, which consist of a cylinder made of actual tobacco that is no longer subject to direct combustion (namely it is not burned, i.e. "lighted-up" by means of a flame), but is heated by means of an electrical resistor so as to generate an aerosol that is inhaled by the smoker (thus without generating neither smoke nor ash). As a result, in order to smoke a new-generation HeatStick cigarette an electronic device is used, provided with electrical resistor and in which an end of a HeatStick cigarette is inserted.

The new-generation HeatStick cigarettes have a cylindrical shape, they have approximately the diameter of a traditional cigarette and have a considerably reduced length (about half) with respect to a traditional cigarette; consequently, rigid packs with hinged lid having a cross-section similar to traditional rigid packs of cigarettes and a height approximately halved with respect to traditional packs of cigarettes were proposed, so as to house a group of new-generation HeatStick cigarettes. An example of a rigid pack with hinged lid to house a group of new-generation HeatStick cigarettes is provided in patent application WO2016166692A1.

However, market surveys have illustrated that consumers, although showing a positive response to new-generation HeatStick cigarettes, rarely appreciate the rigid packs with which new-generation HeatStick cigarettes are sold, as their reduced height (being different from the height of the traditional packs of cigarettes to which smokers have been accustomed for decades) makes these rigid packs more difficult to be handled (especially when a cigarette must be extracted by opening the lid). For example, in a rigid pack with hinged lid housing a group of new-generation HeatStick cigarettes in order to maintain a proper proportion between the lid and underlying cup-shaped body (namely, so as not to have a cup-shaped body being too small and therefore very difficult to get hold of) it is necessary to reduce the size of the lid which hinders the accessibility of the cigarettes.

Patent Application GB1036133A and Patent Application FR2495444A1 describe a rigid pack of cigarettes comprising: a group of cigarettes; a container whose inner volume is divided into a top chamber that houses the group of tobacco articles and in a bottom chamber which remains available; a lid which is hinged to the container; and a drawer which is arranged in the bottom chamber and is mounted in a sliding manner in the container between a closed position, in which the drawer is completely arranged inside the container, and an open position, in which the drawer is partially pulled out of the container, projects outwards from the container and is accessible from the outside.

DESCRIPTION OF THE INVENTION

The object of the present invention is to provide a rigid pack for tobacco articles with lid and provided, at the bottom, with a pull-out container, which rigid pack for tobacco articles is free from the drawbacks described above and is, at the same time, easy and inexpensive to implement.

According to the present invention, a rigid pack for tobacco articles with lid is obtained and provided, at the bottom, with a pull-out container as claimed in the appended claims.

BRIEF DESCRIPTION OF THE DRAWINGS

The present invention will now be described with reference to the accompanying drawings, which illustrate some examples of non-limiting embodiments, wherein.

PREFERRED EMBODIMENTS OF THE INVENTION

Figure 2:
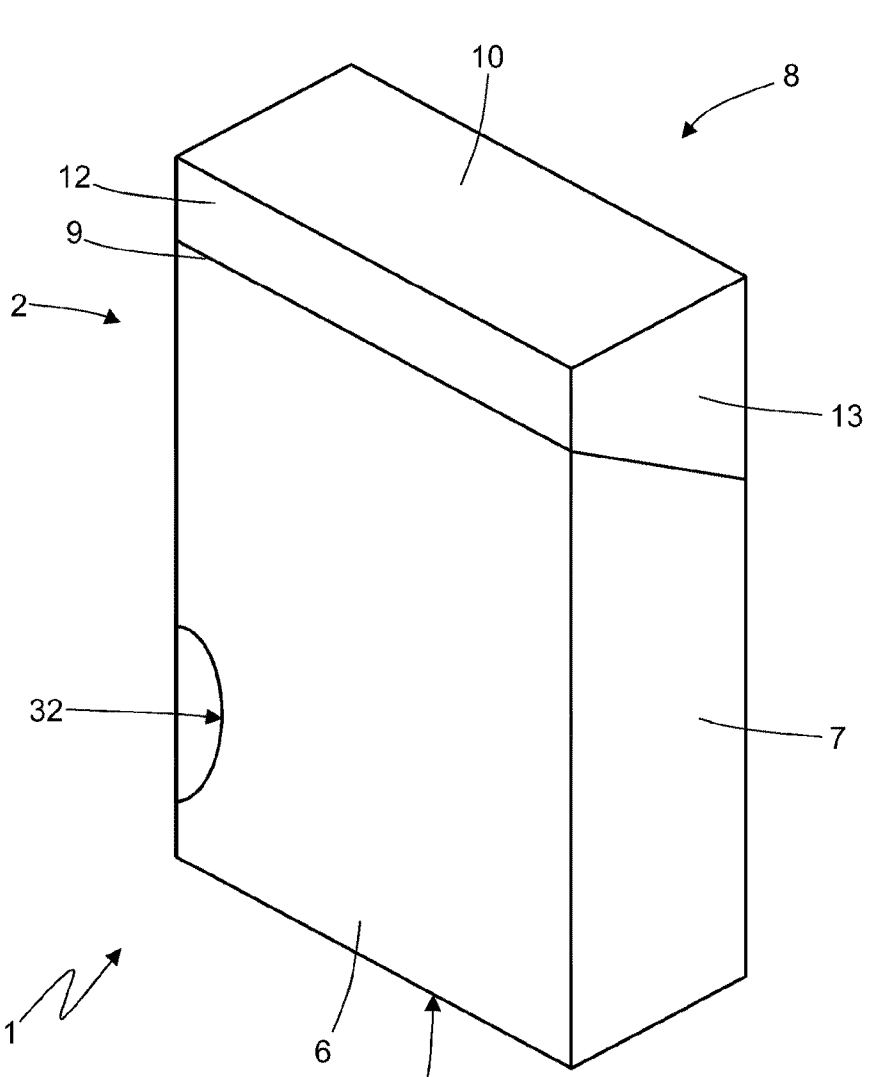
FIG. 2 is a rear perspective view of the pack of cigarettes of FIG. 1 in a closed configuration.
Figure 1:
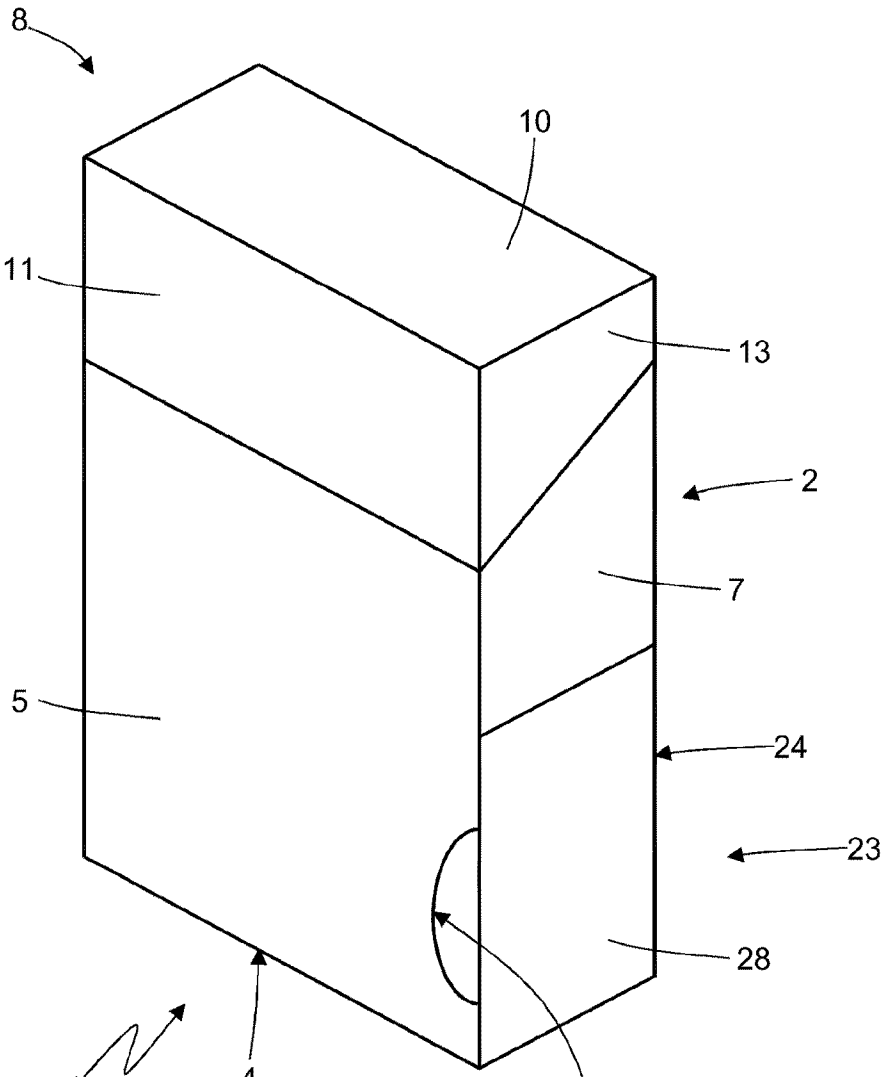
FIG. 1 is a front perspective view of a pack of cigarettes which is made according to the present invention and is in a closed configuration.
Figure 3:
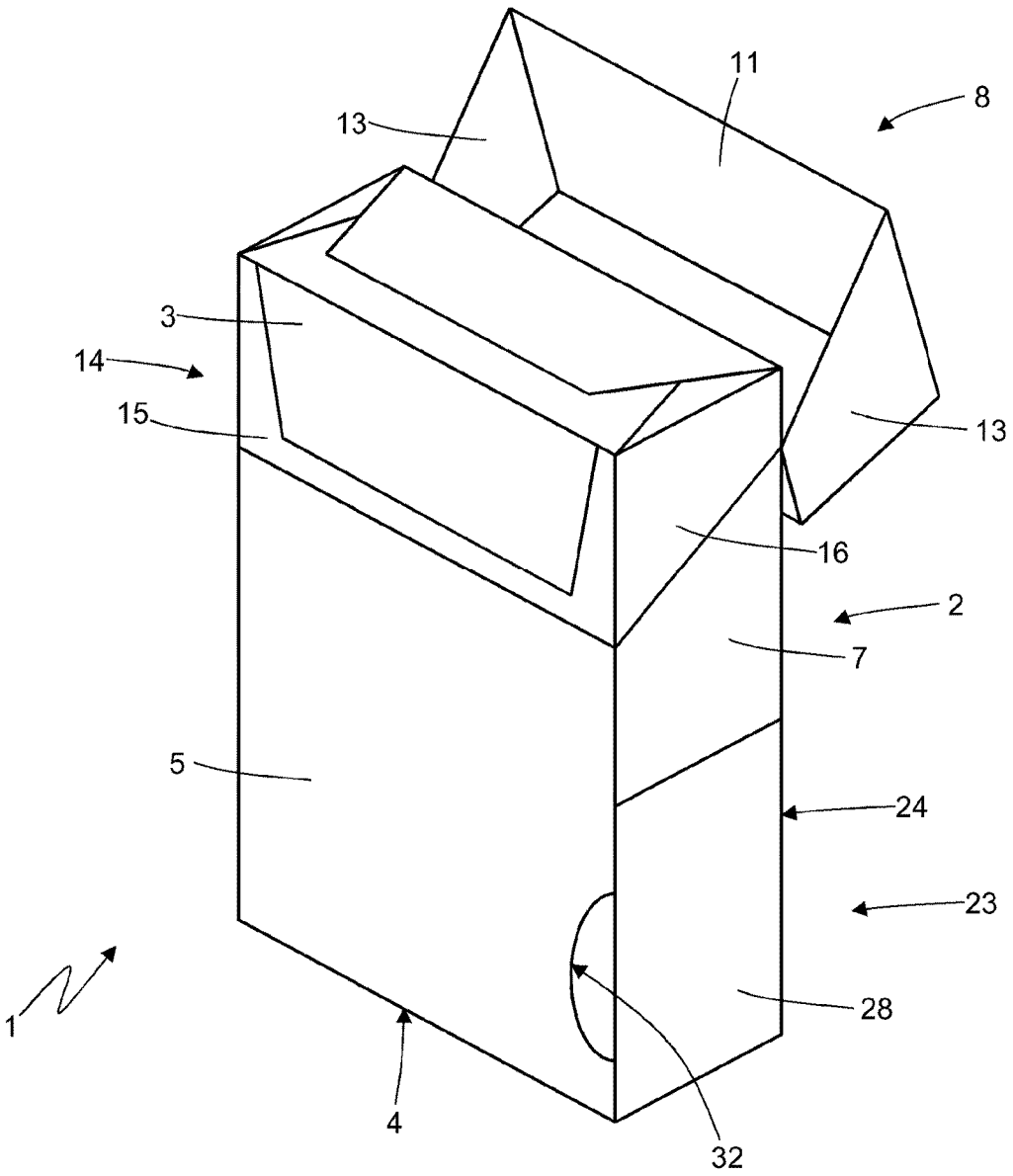
FIG. 3 is a front perspective view of the pack of cigarettes of FIG. 1 in a configuration open at the top.

In FIGS. 1, 2 and 3, number 1 denotes as a whole a rigid pack of cigarettes for a group of new-generation HeatStick cigarettes (not illustrated).

The new-generation smoke-free cigarettes (also called "HeatStick"), consist of a cylinder made of actual tobacco that is no longer subject to direct combustion (namely it is not burned, i.e. "lighted-up" by means of a flame), but is heated by means of an electrical resistor so as to generate an aerosol that is inhaled by the smoker (thus without generating neither smoke nor ash). As a result, in order to smoke a new-generation HeatStick cigarette an electronic device is used, which is provided with an electrical resistor, and in which an end of the HeatStick cigarette itself is inserted.

The pack 1 of cigarettes is made of rigid cardboard or paperboard, has a parallelepiped shape and comprises a cup-shaped rigid container 2 and a wrap 3 (partially visible in FIG. 3) housed inside the container 2.

The container 2 is cup-shaped and has: a top opening, a bottom wall 4 opposite the top opening, a front wall 5, a rear wall 6 opposite the front wall 5, and two side walls 7 opposite to one another. Between the walls 5, 6 and 7, four longitudinal edges are defined, whereas four transverse edges are defined between the walls 4, 5, 6 and 7.

The container 2 is provided with a rigid lid 8 which is hinged to the container 2 along a hinge 9 (arranged at the bottom wall 4 of the container 2 and visible in FIG. 2) and is mobile between a closed position (illustrated in FIGS. 1 and 2) in which the lid 8 covers the top opening of the container 2 and an open position (illustrated in FIG. 3) in which the lid 8 leaves free access to the top opening of the container 2. The lid 8 is cup-shaped and has: a bottom opening, a top wall 10 opposite the bottom opening, a front wall 11, a rear wall 12 opposite the front wall 11 and connected to the rear wall 6 of the container 2 by means of the hinge 9, and two side walls 13 opposite to one another. Four longitudinal edges are defined between the walls 11, 12 and 13, whereas four transverse edges are defined between the walls 10, 11, 12 and 13.

The wrap 3 encloses a group of new-generation HeatStick cigarettes (non-illustrated) and is formed by a wrap of metalized sheet folded around the group of new-generation HeatStick cigarettes. According to a different embodiment, the wrap 3 is of a sealed type and has, at the top and at the front, a pull-out opening closed by a reusable sealing label (namely internally provided with a repositionable adhesive that does not dry); a connection tab of the closing label can be glued to the front wall 11 of lid 8 so that the closing label is "automatically" opened and closed by exploiting the movement of the lid 8 (as described for example in patent application BO2015A000185). According to a further embodiment, instead of a single wrap 3, two twin and side by side wraps 3 are provided, namely the single wrap 3 is divided into two twin, side by side and half-sized wraps 3 (as described in the patent application As illustrated in FIG. 3, the pack 1 of cigarettes further comprises a rigid collar 14 (made of rigid cardboard or paperboard), which is connected (by gluing) Folded in a "U"-shape inside the container 2 to partially project outwards from the top open end and engage a corresponding inner surface of the lid 8 when the lid 8 itself is arranged in the closed position. The collar 14 comprises a front wall 15 which is connected (preferably glued) to the front wall 5 of the container 2 and in contact with the front wall 11 of the lid 8 when the lid 8 is in the closed position and two side walls 16 opposite to one another, which are connected (preferably glued) to the side walls 7 of the container 2 and are in contact with the side walls 13 of the lid 8 when the lid 8 is in the closed position. According to a preferred embodiment illustrated in the attached figures, the front wall 15 of the collar 14 has a "U"-shaped recess to facilitate the extraction of the cigarettes. According to a preferred embodiment, the front wall 15 of the collar 14 is provided with a pair of claw-shaped elements laterally projecting to engage the side walls 16 of the lid 8 when the lid 8 is in the closed position in order to keep the lid 8 in the closed position (alternatively, the front wall 15 of the collar 14 may be free of the claw-shaped elements).

If the wrap 3 is of a sealed type, the wrap 3 itself can comprise a rigid reinforcement element on the inside thereof; in this case, the collar 14 can still be present or can also be absent.

Figure 4:
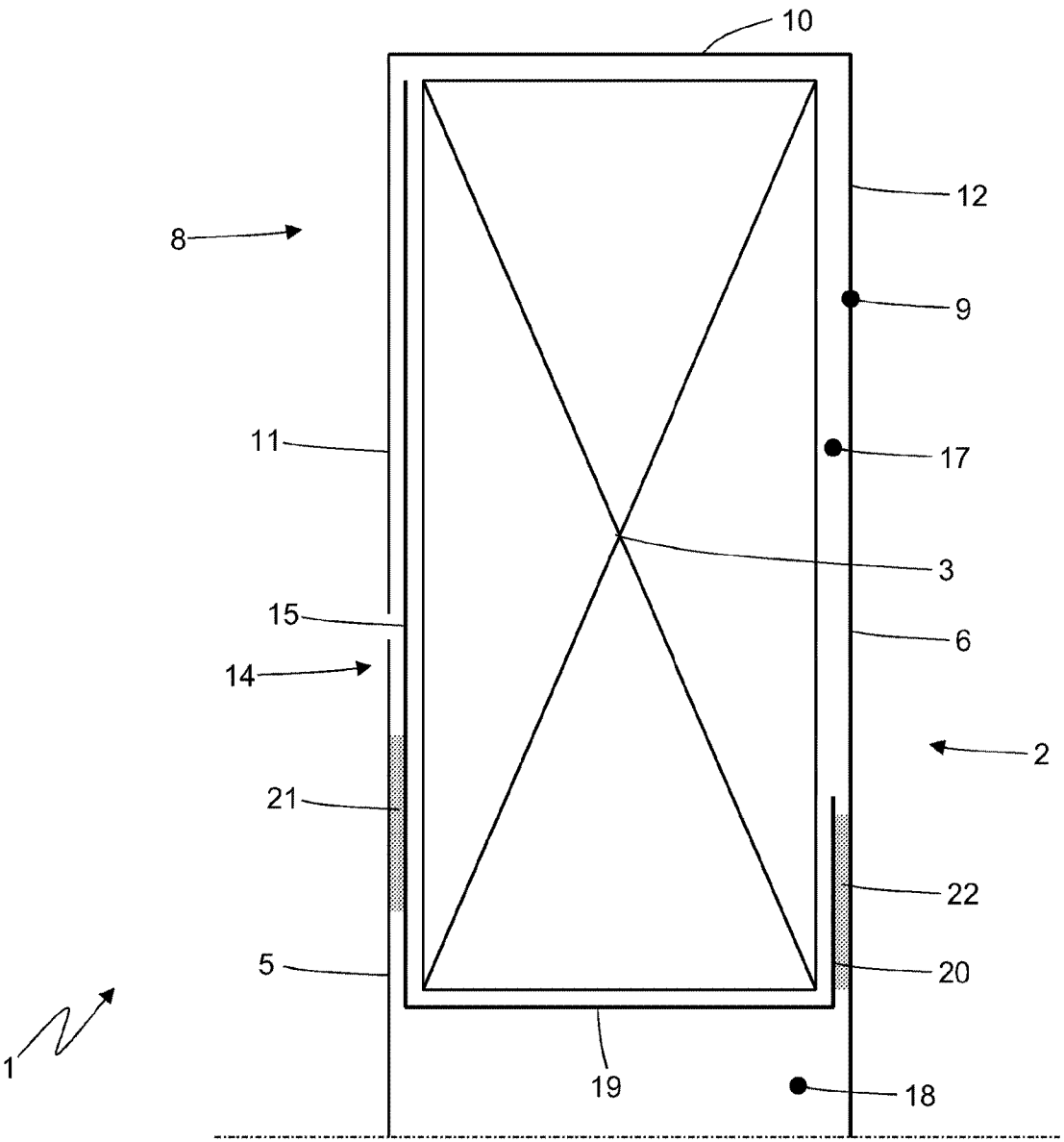
FIG. 4 is a schematic and in longitudinal section view of a top portion of the pack of cigarettes of FIG. 1.

As illustrated in FIG. 4, the inner volume of the container 2 is divided into a top chamber 17 (fully visible in FIG. 4) which houses the wrap 3 and a bottom chamber 18 (partially visible in FIG. 4) which is available and can, therefore, be used (as described below) to house an accessory or to house the cigarettes already used and therefore exhausted (it is important to note that new-generation HeatStick cigarettes are not consumed as they do not burn but are exhausted when their aromatic content ends). The new-generation HeatStick cigarettes have a cylindrical shape, they have approximately the diameter of a traditional cigarette and have a considerably reduced length (about half the size) with respect to a traditional cigarette; consequently, the wrap 3 has the same transverse cross-section as a traditional wrap and has a height approximately halved with respect to a traditional wrap. Thus, assuming that the pack 1 of cigarettes (namely, the container 2 and the lid 8) has the same size as a traditional pack of cigarettes, the top chamber 17 and the bottom chamber 18 have approximately the same volume equal to about half the total volume (namely the two chambers 17 and 18 divide the total volume by half). In this way, the bottom chamber 18 is able to contain all the new-generation HeatStick cigarettes housed in top chamber 17 when the new-generation HeatStick cigarettes are exhausted; in other words, the fact that the bottom chamber 18 has about the same volume as the top chamber 17 it is intended to obtain a specific technical effect, namely, allow the bottom chamber 18 to house all the new-generation HeatStick cigarettes housed in the top chamber 17 when the new-generation HeatStick cigarettes are exhausted.

According to a preferred embodiment illustrated in FIG. 4, a dividing wall 19 is provided, which is parallel to the bottom wall 4 of the container 2 and to the top wall 10 of the lid 8, and divides the top chamber 17 from the bottom chamber 18 (namely divides the inner volume of the container 2 in the top chamber 17 and in the bottom chamber 18). According to a preferred embodiment illustrated in FIG. 4, the dividing wall 19 is part of the collar 14, namely, is connected to the front wall 15 of the collar 14 along a transverse folding line and is folded by 90° relative to the front wall 15 of the collar 14. According to a preferred embodiment illustrated in FIG. 4, the dividing wall 19 is provided with a connection tab 20 which is connected to the dividing wall 19 along a transverse folding line, is folded by 90° relative to the dividing wall 19, and rests against and is glued to the rear wall 6 of the container 2. As illustrated in FIG. 4, the front wall 15 of the collar 14 rests against the front wall 5 of the container 2 and is glued to the front wall 5 of the container 2 by means of a glue 21; furthermore, the connection tab 20 rests against the rear wall 6 of the container 2 and is glued to the rear of the container 2 by means of a glue 22.

Figure 5:
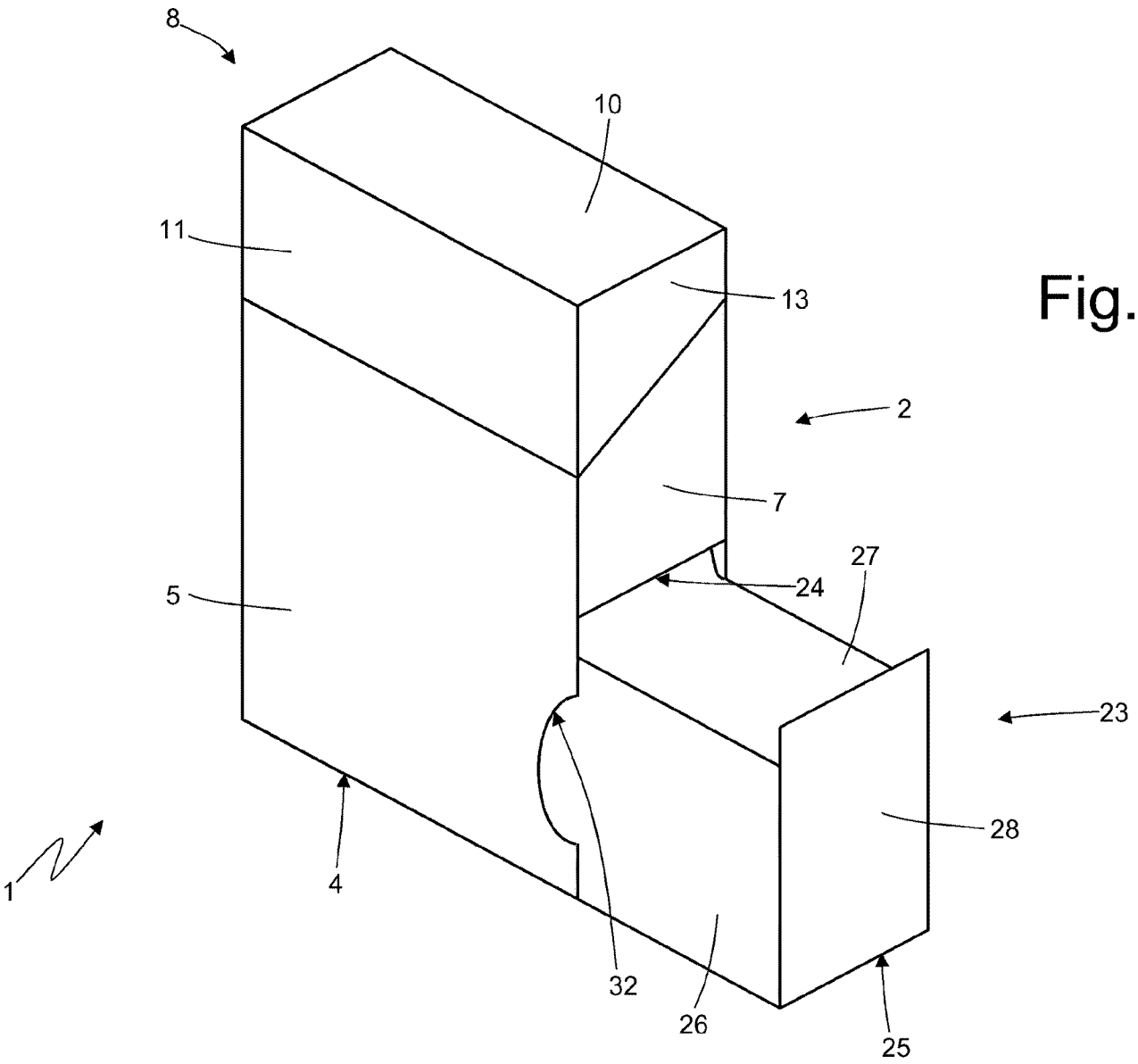
FIG. 5 is a front perspective view of the pack of cigarettes of FIG. 1 in a configuration open at the bottom.

As illustrated in FIG. 5, the pack 1 of cigarettes further comprises a drawer 23 which is arranged in the area of the bottom chamber 18 (namely, below the wrap 3) can slide (has a sliding opening) by means of linear movement between a closed position (illustrated in FIGS. 1, 2 and 3) wherein the drawer 23 is completely arranged inside the container 2 (namely, inside the bottom chamber 18 of the container 2) and an open position (illustrated in FIG. 5) in which the drawer 23 is partially pulled out of the container 2 and projects outwards from the container 2, and is accessible from the outside. In other words, the container 2 houses the drawer 23 in a sliding manner so as to allow the drawer 23 itself to slide relative to the container 2 in order to move with a linear movement between a closed position (illustrated in FIGS. 1, 2 and 3), in which the drawer 23 is completely inserted inside the container 2 and an open position (illustrated in FIG. 2), in which the drawer 23 is partially pulled out of the container 2 so as to allow direct access, by a user, to the drawer 23. According to an alternative embodiment not illustrated, the drawer 23 has a sliding opening by means of a rotatable movement between the closed position and the open position.

In order to allow the movement of the drawer 23 between the open position and the closed position, a wall of the container 2 has a pull-out opening 24 through which the drawer 23 is moved. In the embodiment illustrated in FIGS. 1-5, the drawer 23 moves transversely (namely, with a moving direction that is parallel to the bottom wall 4 of the container 2 and to the top wall 10 of the lid 8 and perpendicular to the side walls 7 of the container 2 and to the side walls 13 of the lid 8), and therefore the pull-out opening 24 for the drawer 23 is formed through a side wall 7 of the container 2.

As illustrated in FIG. 5, the drawer 23 is parallelepiped-shaped and has: a bottom wall 25 parallel to and facing the bottom wall 4 of the container 2, a front wall 26 parallel to the front wall 5 of the container 2, a rear wall 27 parallel to and facing the rear wall 6 of the container 2, and two side walls 28 (only one of which is illustrated in FIG. 5) parallel to the side walls 7 of the container 2. In particular, in the closed position (illustrated in FIGS. 1, 2 and 3) a side wall 28 of the drawer 23 (not shown in FIGS. 1, 2 and 3) faces a corresponding side wall 7 of the container 2 whereas the other side wall 28 of the drawer 23 (illustrated in FIGS. 1 and 3) is coplanar to the corresponding side wall 7 of the container 2, is arranged in the area of the pull-out opening 24 and closes the pull-out opening 24 itself.

Figure 6:
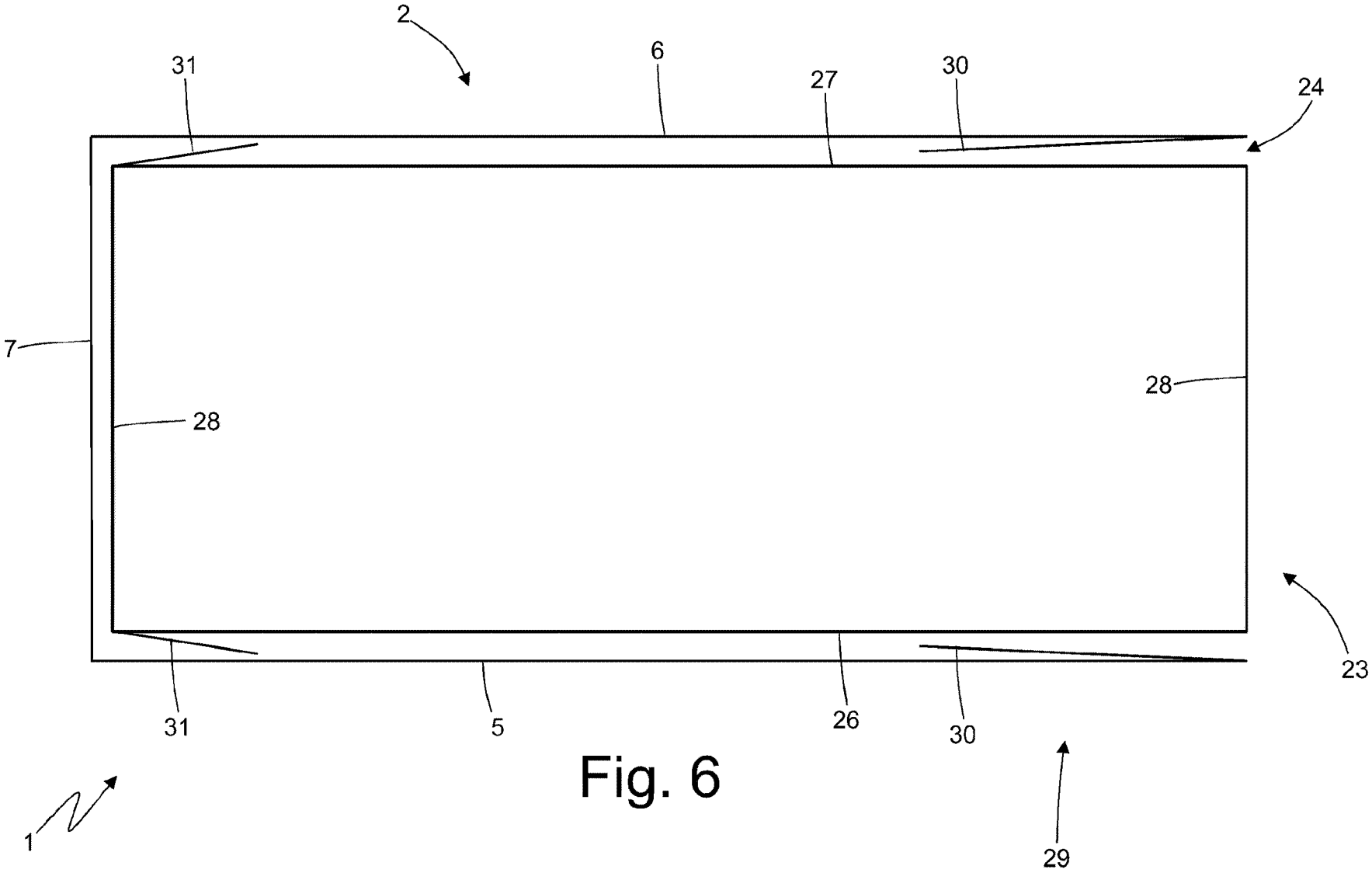
FIG. 6 is a schematic and in cross-section view of a bottom portion of the pack of cigarettes of FIG. 1.

As illustrated in FIG. 6, a limit stop device 29 is provided, which fulfils the function of stopping the outward movement of the drawer 23 from the container 2 in a maximum open position, namely of preventing the drawer 23 from being completely pulled out of the container 2 by setting a maximum limit for the pull-out movement of the drawer 23 from the container 2. The limit stop device 29 comprises two stopping tabs 30, each of which is connected to a side wall 7 of the container 2 in the area of an edge of a pull-out opening 24 and projects from the side wall 7 towards the inside of the container 2. In addition, the limit stop device 29 comprises two stopping tabs 31, each of which is arranged in proximity to the side wall 28 of the drawer 23 opposite the pull-out opening 24 and projects towards the outside of the drawer 23 starting from the edge connecting the front wall 26 or the rear wall 27 to the side wall 28 itself.

According to a preferred embodiment (illustrated in FIG. 9), the front wall 26 and the rear wall 27 of the drawer 23 carry the corresponding stopping tabs 31 that are cut-out from them. In use, namely during the final part of the pull-out movement of the drawer 23, each stopping tab 31 engages (namely couples, is inserted inside) the corresponding stopping tab 30 causing the stop of the pull-out movement of the drawer 23 (namely preventing the drawer 23 from being completely pulled out of the container 2).

According to a preferred embodiment illustrated in FIGS. 1, 2, 3 and 5, the front wall 5 and the rear wall 6 of the container 2 comprise respective claw-shaped holding recesses 32, which allow a user to get hold of the underlying walls 26 and 27 of the drawer 23 and then pull out the drawer 23 towards the outside, to move the drawer 23 from the closed position to the open position.

According to a possible and non-limiting embodiment (which can be added or modified in respect to the presence of the holding recess 32), the side wall 7 of the container 2 opposite the pull-out opening 24 has a hole, which has such form and dimensions so as to allow the user, through the side wall 7 itself, to exert a force on the corresponding side wall 28 of the drawer 23 so as to allow the drawer 23 itself to slide towards its open position.

Figure 7:
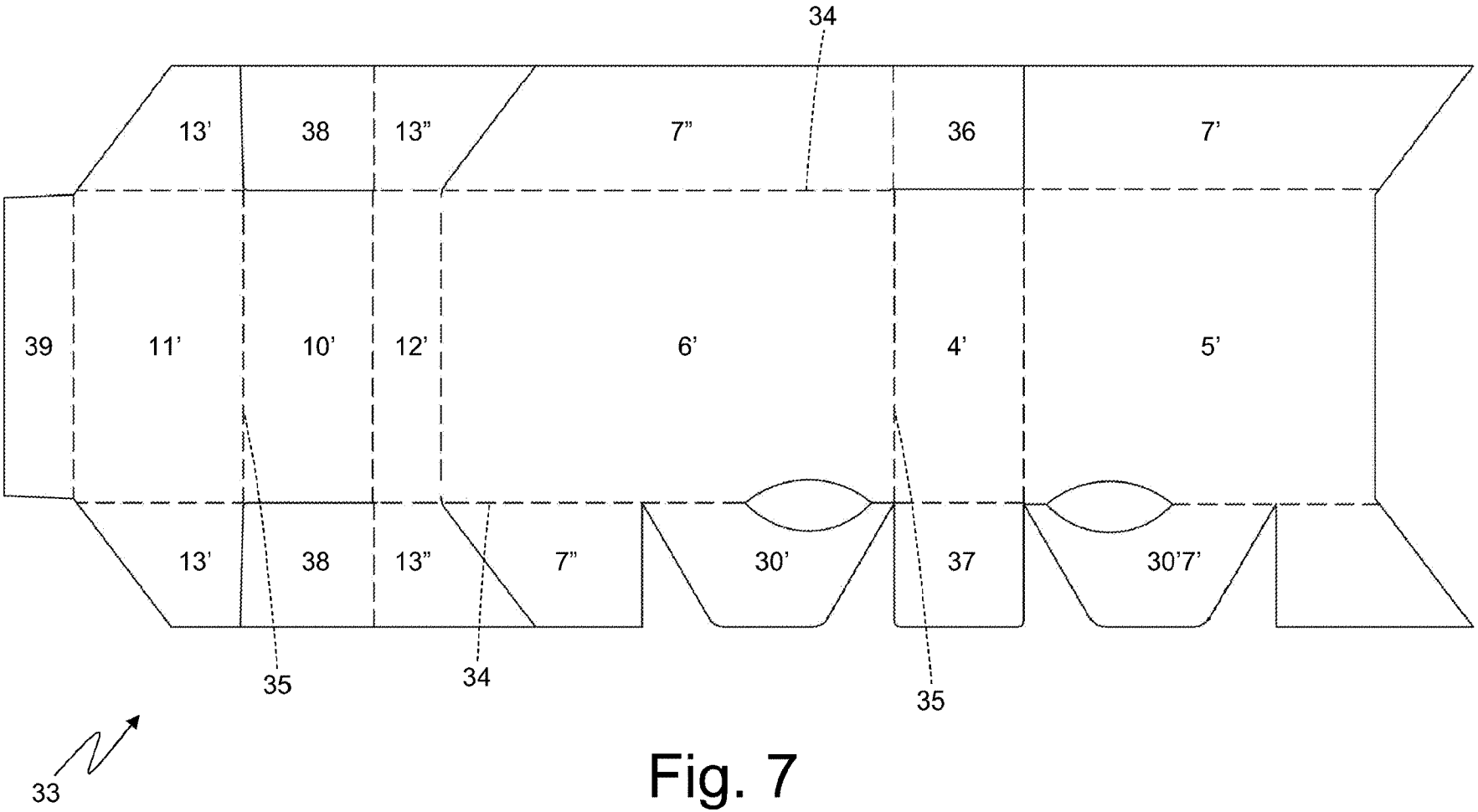
FIG. 7 is a plan view of a blank used to make a container and a lid of the pack of cigarettes of FIG. 1.

As illustrated in FIG. 7, the container 2 and the lid 8 are obtained starting from a flat blank 33 having a substantially rectangular elongated shape. The blank 33 has two longitudinal folding lines 34 and a plurality of transverse folding lines 35, which define, between the two longitudinal folding lines 34, a panel 11' making up the front wall 11 of the lid 8, a panel 10' making up the top wall 10 of the lid 8, a panel 12' making up the rear wall 12 of the lid 8, a panel 6' making up the rear wall 6 of the container 2, a panel 4' making up the bottom wall 4 of the container 2 and a panel 5' making up the front wall 5 of the container 2. The transverse folding line 35, which divides the panels 12' and 6' makes up the hinge 9 of the lid 8.

The panel 5' has two wings 7', which are arranged on opposite sides of the panel 5', are connected to the panel 5' by means of the longitudinal folding lines 34 and make up the outer parts of the two side walls 7 of the container 2. The panel 6' has two wings 7", which are arranged on opposite sides of the panel 6', are connected to the panel 6' by means of the longitudinal folding lines 34 and make up the inner parts of the two side walls 7 of the container 2. The panel 11' has two wings 13', which are arranged on opposite sides of panel 11', are connected to panel 11' by means of the longitudinal folding lines 34 and make up the outer parts of two side walls 13 of lid 8. The panel 12' has two wings 13", which are arranged on opposite sides of the panel 12', are connected to panel 12' by means of the longitudinal folding lines 34 and make up the inner parts of the two side walls 13 of the lid 8.

The panel 5' also comprises an additional wing 30', which is arranged beside a corresponding wing 7', is connected to the panel 5' along a longitudinal folding line 34 and makes up a stopping tab 30 of the limit stop device 29. Likewise, the panel 6' also comprises an additional wing 30', which is arranged beside a corresponding wing 7", is connected to the panel 6' along a longitudinal folding line 34 and makes up a stopping tab 30 of the limit stop device 29.

A wing 7" has a tab 36 which is connected to the wing 7" by means of a transverse folding line 35 and is folded by 90° to be glued to an inner surface of the panel 4'. The panel 4' comprises a tab 37 which is connected to the panel 4' by means of a longitudinal folding line 34 and is folded by 180° against the panel 4' to be glued to an inner surface of the panel 4'.

Each wing 13" has a tab 38 which is connected to the wing 13" by means of a transverse folding line 35 and is folded by 90° to be glued to an inner surface of the panel 10'.

Finally, the panel 11' has a flap 39 which is connected to the panel 11' by means of a transverse folding line 35 and is folded by 180° against the panel 11' to be glued to an inner surface of the panel 11' itself.

Figure 8:
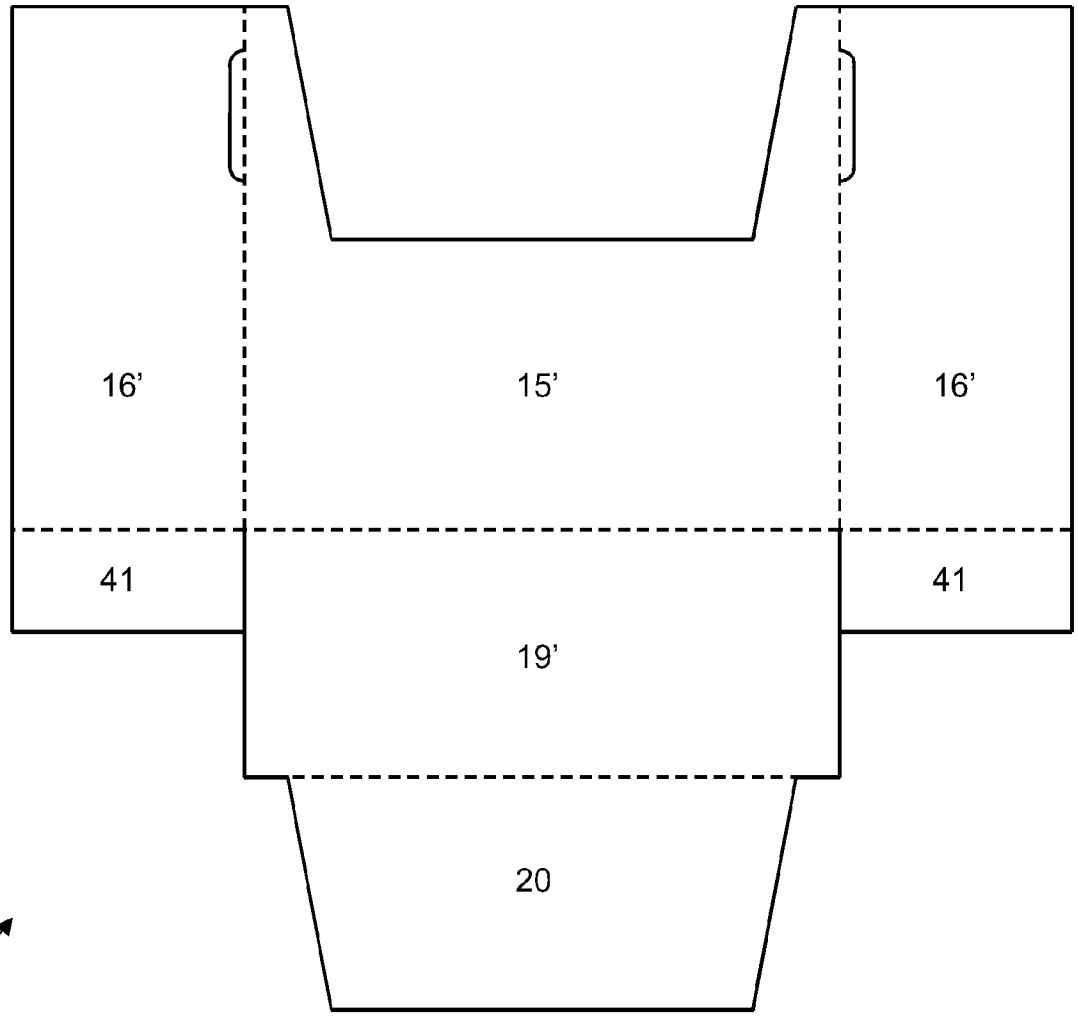
FIG. 8 is a plan view of a blank used to make a collar of the pack of cigarettes of FIG. 1.

As illustrated in FIG. 8, the collar 14 is obtained starting from a blank 40 having: a panel 15' making up the front wall 15 of the collar 14, a panel 19' making up the dividing wall 19 of the collar 14, and a panel 20' making up the connection tab 20 of the collar 14. Two wings 16' are connected to the panel 15' which make up the side walls 16 of the collar 14. Each wing 16' has a tab 41 which is folded by 90° to be glued to an inner surface of the panel 19'.

Figure 9:
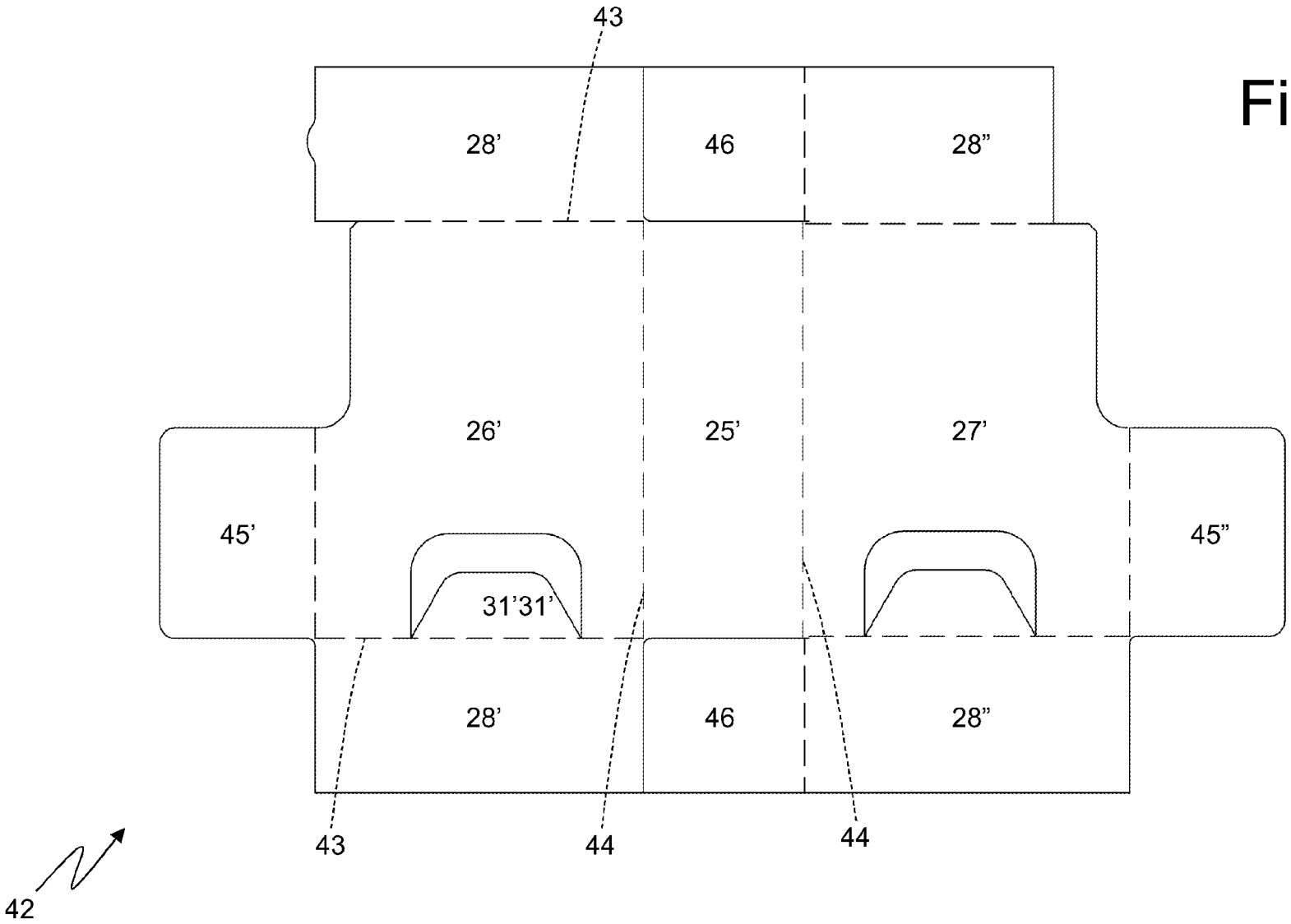
FIG. 9 is a plan view of a blank used to make a drawer of the pack of cigarettes of FIG. 1.

As illustrated in FIG. 9, the drawer 23 is obtained starting from a flat blank 42 having a substantially rectangular shape. The blank 42 has two longitudinal folding lines 43 and a plurality of transverse folding lines 44, which define, between the two longitudinal folding lines 43, a panel 45' making up an outer part of a top wall of the drawer 23 (not illustrated), a panel 26' making up the front wall 26 of the drawer 23, a panel 25' making up the bottom wall 25 of the drawer 23, a panel 27' making up the rear wall 27 of the drawer 23, and a panel 45" making up an inner part of the top wall of the drawer 23.

The panel 26' has two wings 28', which are arranged on opposite sides of the panel 26', are connected to the panel 26' by means of the longitudinal folding lines 43 and make up the outer parts of the two side walls 28 of the drawer 23. The panel 27' has two wings 28", which are arranged on opposite sides of the panel 27', are connected to the panel 27' by means of the longitudinal folding lines 43 and make up the inner parts of the two side walls 28 of the drawer 23.

Each wing 28" has a tab 46, which is connected to the wing 28" by means of a transverse folding line 44 and is folded by 90° to be glued to an inner surface of the panel 25'.

Passing through windows are provided inside the panels 26' and 27', in which appendages 31' are obtained, which make up the stopping tabs 31'.

In the embodiment illustrated in FIGS. 1-5, the drawer 23 can comprise a top wall (visible only in the panels 45' and 45" of the blank 42 illustrated in FIG. 9), which must have a limited extension so as to allow access from the top inside the drawer 23. According to alternative embodiments, the drawer 23 is without a top wall.

Figure 10:
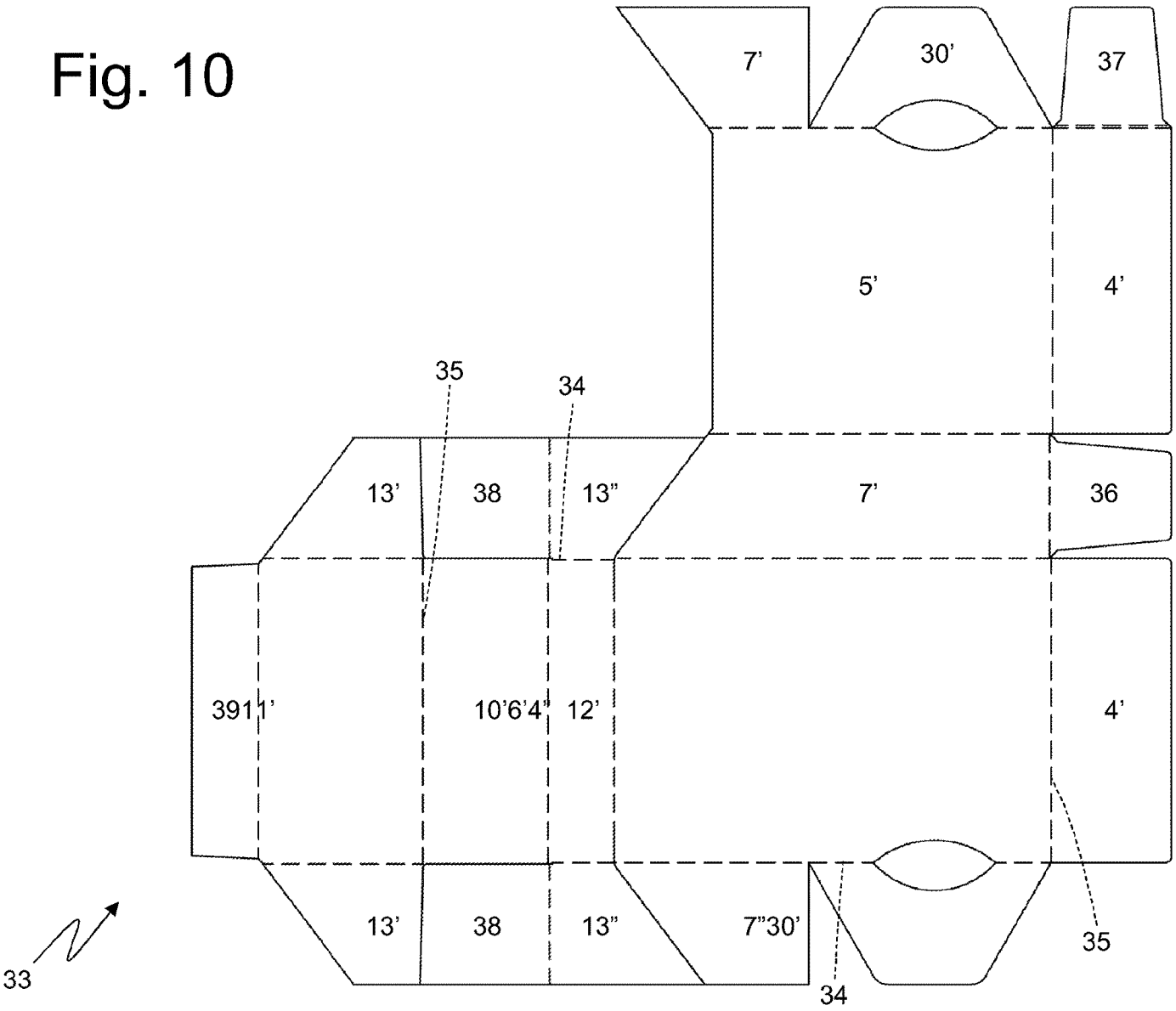
FIG. 10 is a plan view of an alternative of the blank of FIG. 7.

In FIG. 10 an alternative of the blank 33, illustrated in FIG. 7, for making the container 2 and lid 8 is illustrated. The blank 33 illustrated in FIG. 10 has a "L" shape in which the wing 7' is connected on one side to the panel 6', which makes up the rear wall 6 of the container 2 along a longitudinal folding line 34 and is connected on the other side to the panel 5', which makes up the front wall 5 of the container 2 along a further longitudinal folding line 34. In addition, the blank 33 illustrated in FIG. 10 has two different panels 4' and 4" which are respectively connected to the panels 5' and 6' by means of a transverse folding line 35 and are superimposed one on the other to form the bottom wall 4 of the container 2. Finally, in the blank 33 illustrated in FIG. 10, the tab 36 is connected to the wing 7' and is folded by 90° relative to the wing 7' to be glued to an inner surface of the panel 4".

In the embodiment illustrated in FIGS. 1-5, the drawer 23 moves transversely (namely, with a moving direction that is parallel to the bottom wall 4 of the container 2 and to the top wall 10 of the lid 8 and perpendicular to the side walls 7 of the container 2 and to the side walls 13 of the lid 8), and therefore the pull-out opening 24 for the drawer 23 is formed through a side wall 7 of the container 2. In the alternative embodiment illustrated in FIGS. 11-13, the drawer 23 moves longitudinally (namely, with a moving direction that is perpendicular to the top wall 10 of the lid 8 and parallel to the side walls 7 of the container 2 and to the side walls 13 of the lid 8), and therefore the pull-out opening 24 for the drawer 23 is formed through the bottom wall 4 of the container 2 and preferably completely replaces the bottom wall 4 of the container 2 (namely the bottom wall 4 of the container 2 is no longer present and is completely replaced by the pull-out opening 24).

Figure 12:
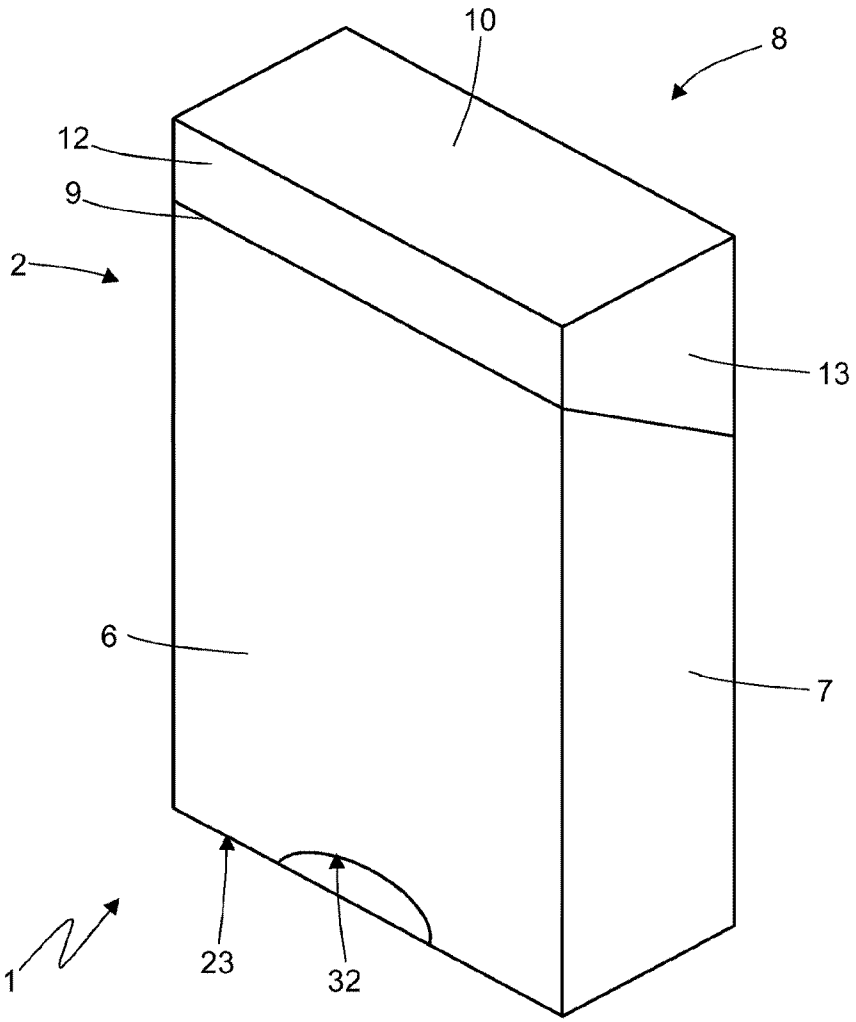
FIG. 12 is a rear perspective view of the pack of cigarettes of FIG. 11 in a closed configuration.
Figure 11:
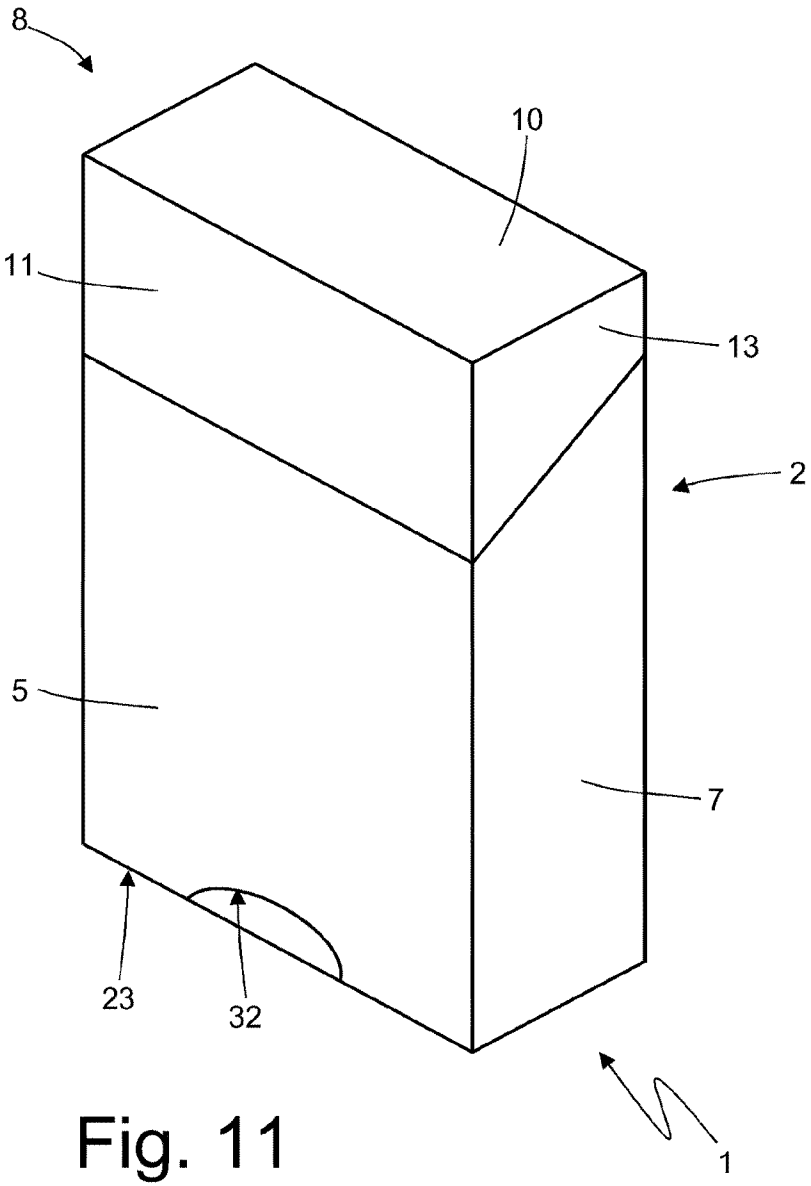
FIG. 11 is a front perspective view of a different embodiment of a pack of cigarettes that is made according to the present invention and is in a closed configuration.
Figure 13:
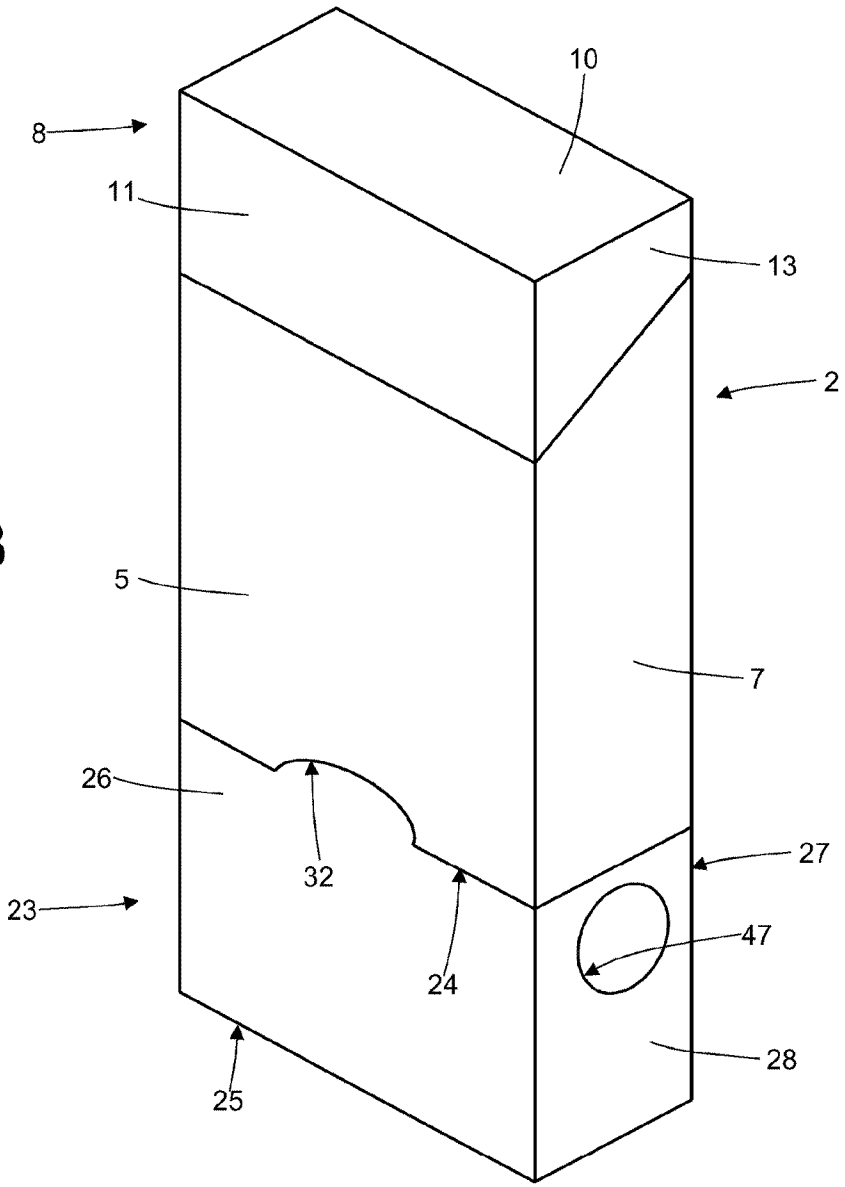
FIG. 13 is a front perspective view of the pack of cigarettes of FIG. 11 in a configuration open from the bottom.

It is important to note that in the area of the top chamber 17 (namely in the area of the lid 8, of the wrap 3 and of the collar 14), the pack 1 of cigarettes illustrated in FIGS. 11-13 is entirely identical to the pack 1 of cigarettes illustrated in FIGS. 1-5.

As illustrated in FIG. 13, a side wall 28 of the drawer 23 has a circular-shaped access opening 47 (obviously any other type of shape other than the circular shape could be possible) through which it is possible to access (in particular to insert objects) inside the drawer 23; according to alternative embodiments not illustrated, the access opening 47 is formed in the front wall 26 or in the rear wall 27 of the drawer 23 (it is also possible to have several access openings 47 in different walls of the drawer 23). It is important to note that in the embodiment illustrated in FIGS. 11-13, the access opening 47 is accessible (therefore visible) only when the drawer 23 is extracted (as illustrated in FIG. 13) and is not accessible (therefore visible) when the drawer 23 is closed (as illustrated in FIGS. 11 and 12). In the embodiment illustrated in FIGS. 11-13, holding recesses 32 are formed in the area of the front wall 5 and of the rear wall 6 of the container 2 instead of being formed in the area of the side walls 7 of the container 2 as is shown in the embodiment illustrated in FIGS. 1-5.

In the embodiment illustrated in FIGS. 11-13, the two stopping tabs 31 of the limit stop device 29 are respectively connected to the top edge of the front wall 26 of the drawer 23 and to the top edge of the rear wall 27 of the drawer 23; similarly, the two stopping tabs 30 of the limit stop device 29 are respectively connected to the bottom edge of the front wall 5 of the container 2 and to the bottom edge of the rear wall 6 of the container 2.

In the embodiment illustrated in FIGS. 11-13, the drawer 23 is completely without the top wall; according to an alternative not illustrated, the drawer 23 could also comprise the top wall which could also completely close the drawer 23 as the drawer 23 is laterally accessible through the access opening 47 and must not be accessible from above.

Figure 14:
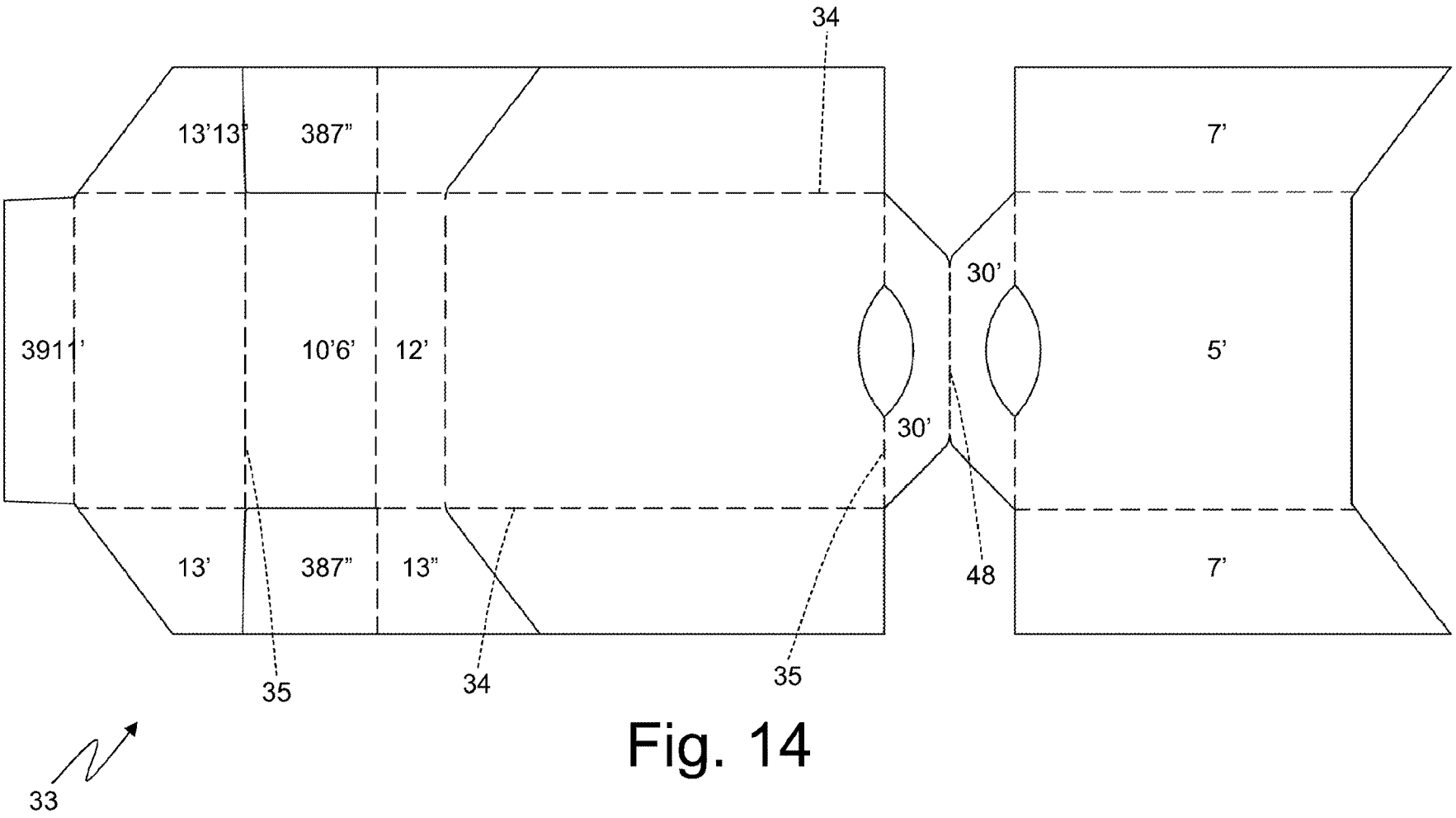
FIG. 14 is a plan view of a blank used to make a container and a lid of the pack of cigarettes of FIG. 11.

As illustrated in FIG. 14, the container 2 and the lid 8 of the pack 1 of cigarettes illustrated in FIGS. 11-13 are obtained starting from a flat blank 33 similar to the flat blank 33 illustrated in FIG. 7. The differences between the blank 33 illustrated in FIG. 7 and the blank 33 illustrated in FIG. 14 are in the different positioning of the wings 30' making up the stopping tabs 30 of the limit stop device 29 and in the absence, in the blank 33 illustrated in FIG. 14, of the panel 4' making up the bottom wall 4 of the container 2. In particular, in the blank 33 illustrated in FIG. 14, the two panels 6' and 5' are initially connected, by a tearable line 47 which connects the two corresponding wings 30' and is torn during the folding of the blank 33 to separate the two wings 30'. In other words, in the blank 33 illustrated in FIG. 14, the panel 4' is replaced by the two wings 30' which are opposite to one another and are connected to one another by the tearable line 47 which is torn during the folding of the blank 33 to separate the two wings 30' themselves.

The blank 40 used to make the collar 14 of the pack 1 of cigarettes illustrated in FIGS. 11-13 is entirely identical to the blank 40 (illustrated in FIG. 8) used to make the collar 14 of the pack 1 of cigarettes illustrated in FIGS. 1-5.

Figure 15:
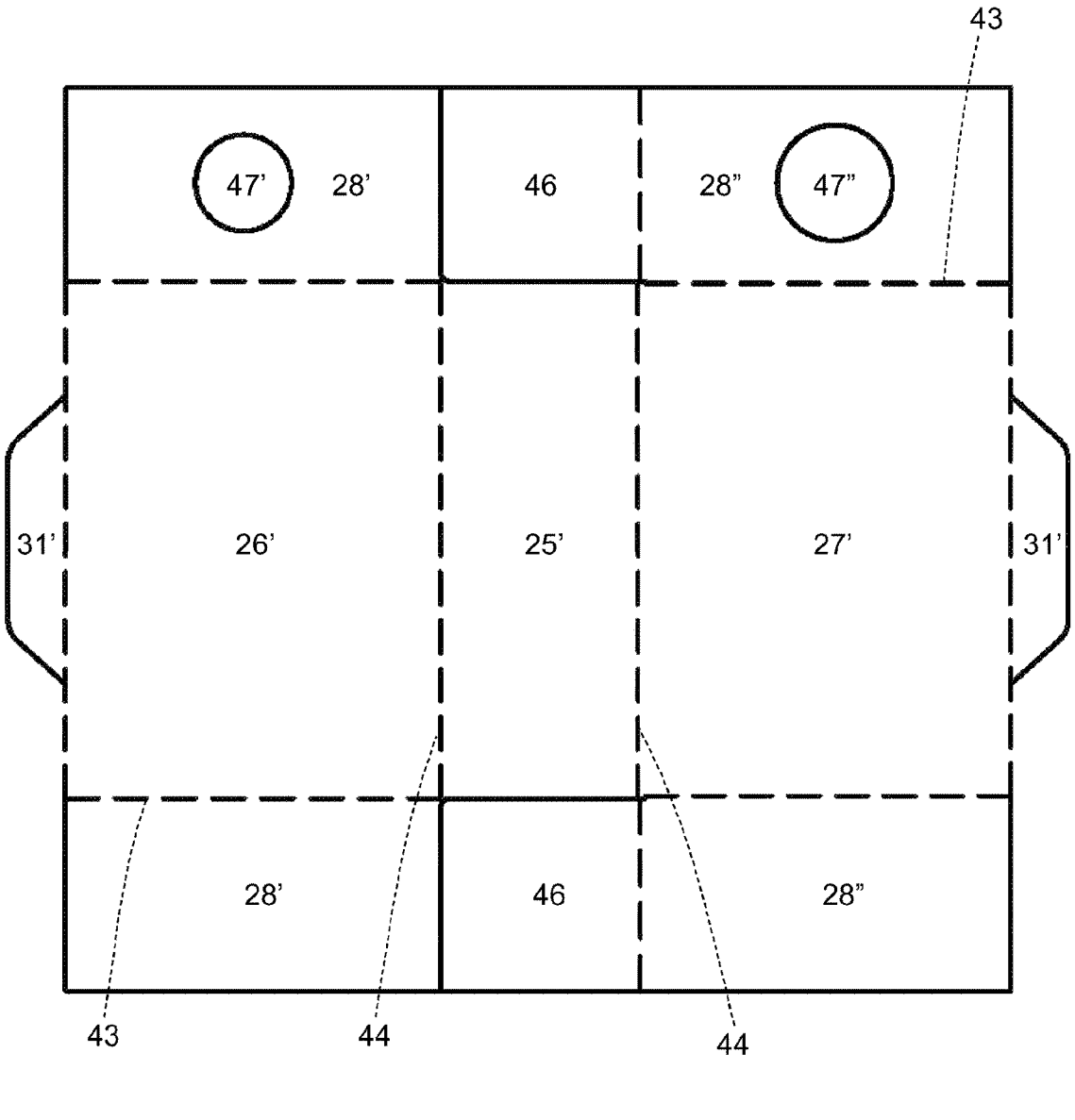
FIG. 15 is a plan view of a blank used to make a drawer of the pack of cigarettes of FIG. 11.
Figure 17:
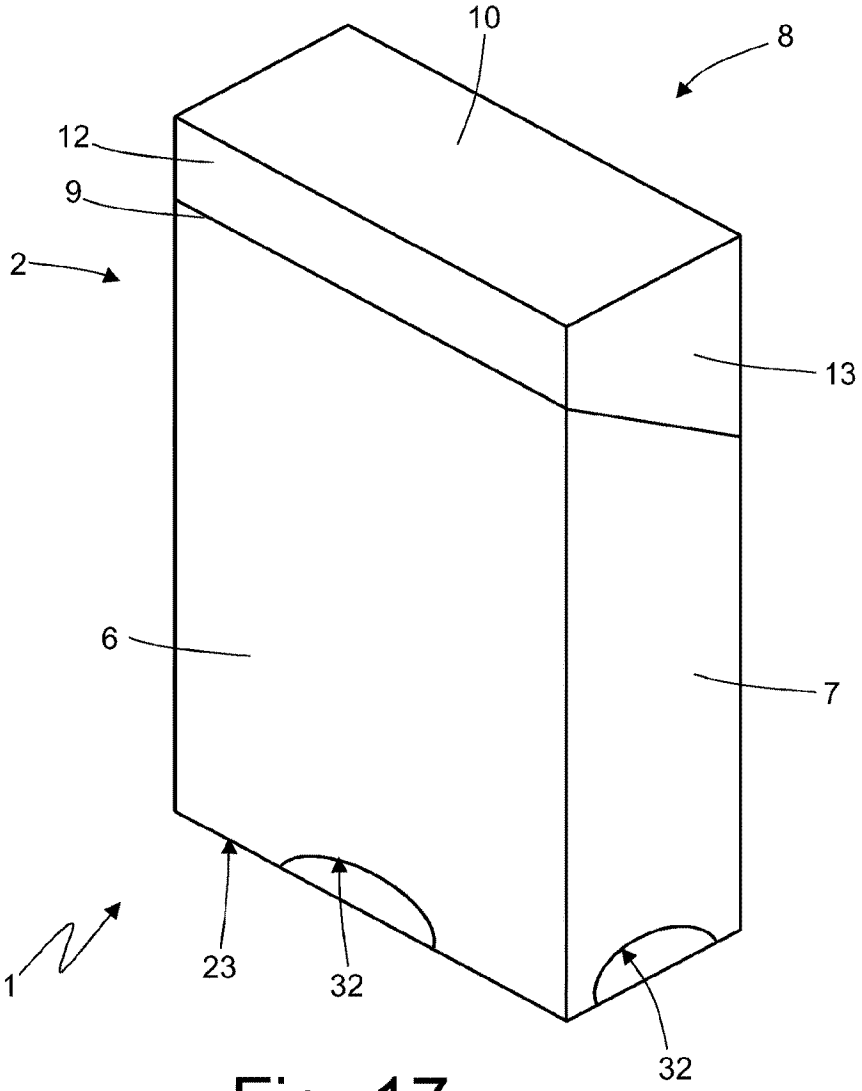
FIG. 17 is a rear perspective view of the pack of cigarettes of FIG. 16 in a closed configuration.

As illustrated in FIG. 15, the drawer 23 of the pack 1 of cigarettes illustrated in FIGS. 11-13 is obtained starting from a flat blank 42 similar to the flat blank 42 illustrated in FIG. 9. The differences between the blank 42 illustrated in FIG. 9 and the blank 42 illustrated in FIG. 15 are in the different positioning of the wings 31' making up the stopping tabs 31 of the limit stop device 29, in the absence, in the blank 42 illustrated in FIG. 15, of the panels 45' and 45" making up the top wall of the drawer 23, and in the presence, in the blank 42 illustrated in FIG. 15, of the holes 47' and 47" which are overlapping one another to make up the access opening 47. Preferably, the hole 47" formed in the wing 28" (which makes up an inner part of a side wall 28 of the drawer 23) has a slightly larger diameter than the hole 47' formed in the wing 28' (which makes up an outer part of a side wall 28 of the drawer 23) so as to prevent any misalignments between the two holes 47' and 47" from being noted from the outside.

Figure 16:
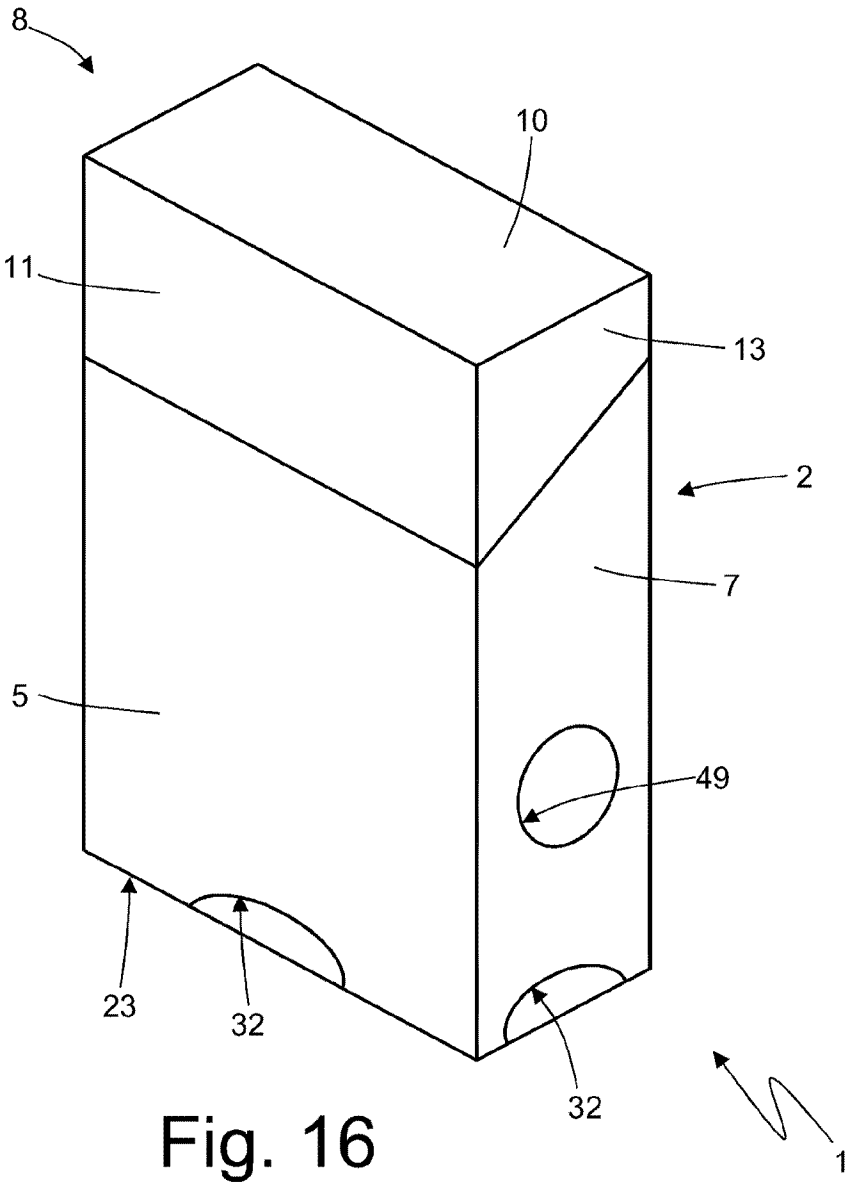
FIG. 16 is a front perspective view of an alternative of the pack of cigarettes of FIG. 11 in a closed configuration.
Figure 18:
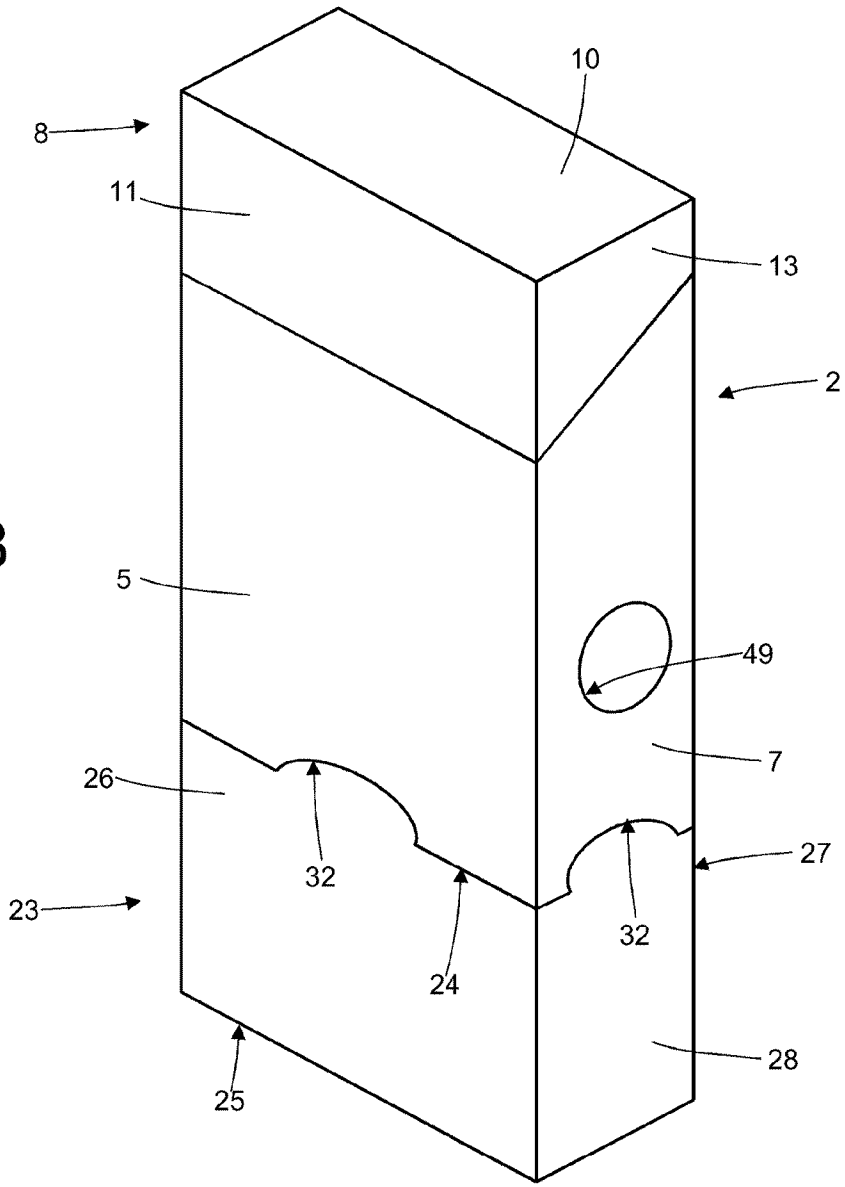
FIG. 18 is a front perspective view of the pack of cigarettes of FIG. 16 in a configuration open at the bottom.

In FIG. 16-19 an alternative of the pack 1 of cigarettes illustrated in FIGS. 11-13 is illustrated, which differs from the pack 1 of cigarettes illustrated in FIGS. 11-13 only for two details: holding recesses 32 are formed both in the area of the front wall 5 and of the rear wall 6 of the container 2, and in the area of the side walls 7 of the container 2 (namely four holding recesses 32 are provided instead of only two holding recesses 32 as in the other embodiments), and the access opening 49 formed in a side wall 28 of the drawer 23 is replaced by a similar access opening 49 formed in a side wall 7 of the container 2. In particular, the access opening 49 is always visible even when the drawer 23 is in the closed position (as illustrated in FIG. 16) but when the drawer 23 is in the closed position it is internally stopped by a corresponding side wall 28 of the drawer 23 and therefore becomes usable only when the drawer 23 is in the open position (as illustrated in FIG. 18).

Figure 19:
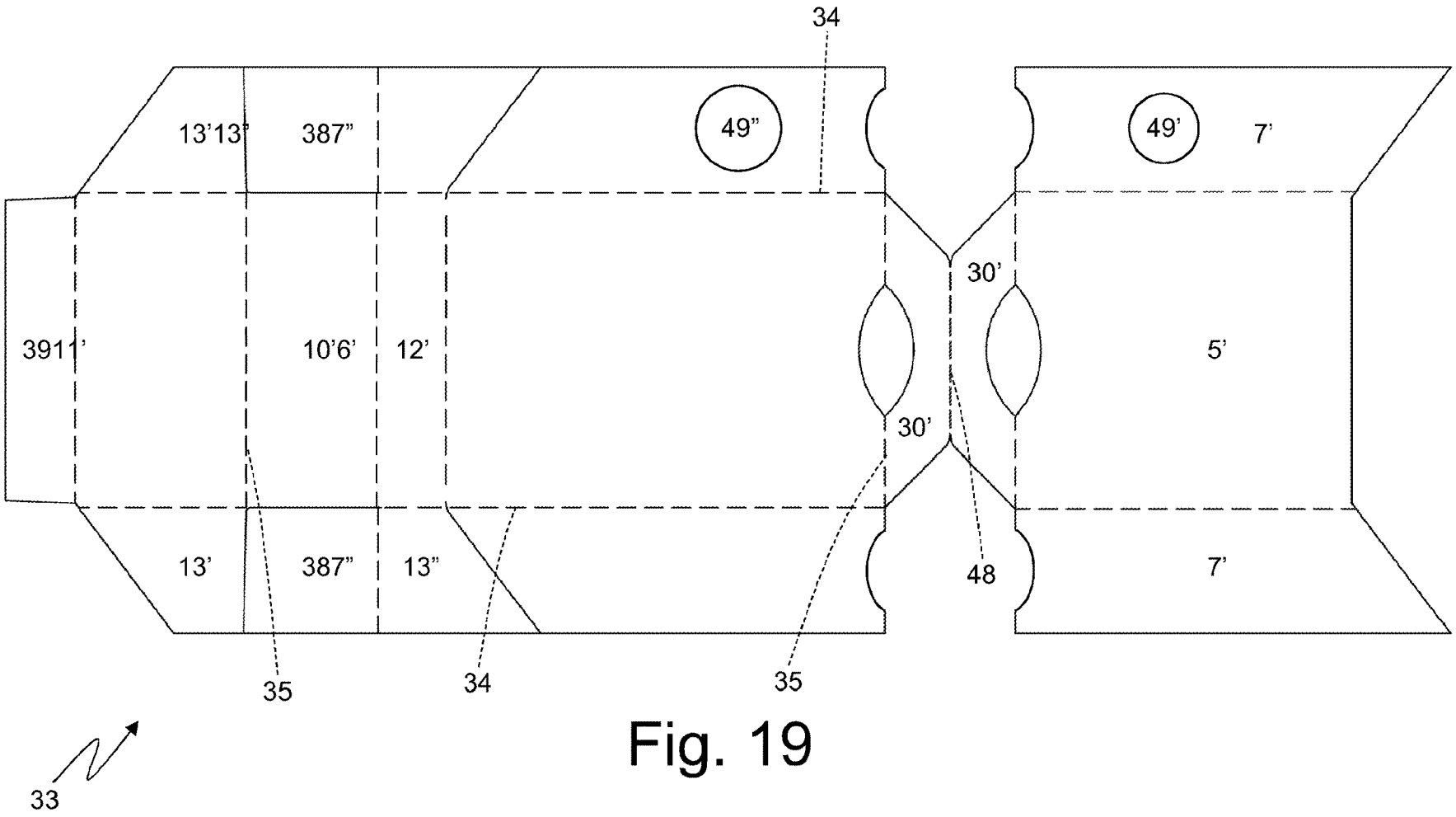
FIG. 19 is a plan view of a blank used to make a container and a lid of the pack of cigarettes of FIG. 16.

As illustrated in FIG. 19, the container 2 and the lid 8 of the pack 1 of cigarettes illustrated in FIGS. 16-19 are obtained starting from a flat blank 33 which is almost identical to the flat blank 33 illustrated in FIG. 14, from which it differs only for the presence of the holding recesses 32 also in the wings 7' and 7" and in the presence of the holes 49' and 49" which are superimposed one another to make up an access opening 49. Preferably, the hole 49" formed in the wing 7" (which makes up an inner part of a side wall 7 of the container 2) has a slightly larger diameter than the hole 49' formed in the wing 7' (which makes up an outer part of a side wall 7 of the container 2) so as to prevent any misalignments between the two holes 49' and 49" from being noted from the outside.

The blank 40 used to make the collar 14 of the pack 1 of cigarettes illustrated in FIGS. 16-19 is entirely identical to the blank 40 used to make the collar 14 of the pack 1 of cigarettes illustrated in FIGS. 11-13 and to the blank 40 (illustrated In FIG. 8) used to make the collar 14 of the pack 1 of cigarettes illustrated in FIGS. 1-5.

Figure 20:
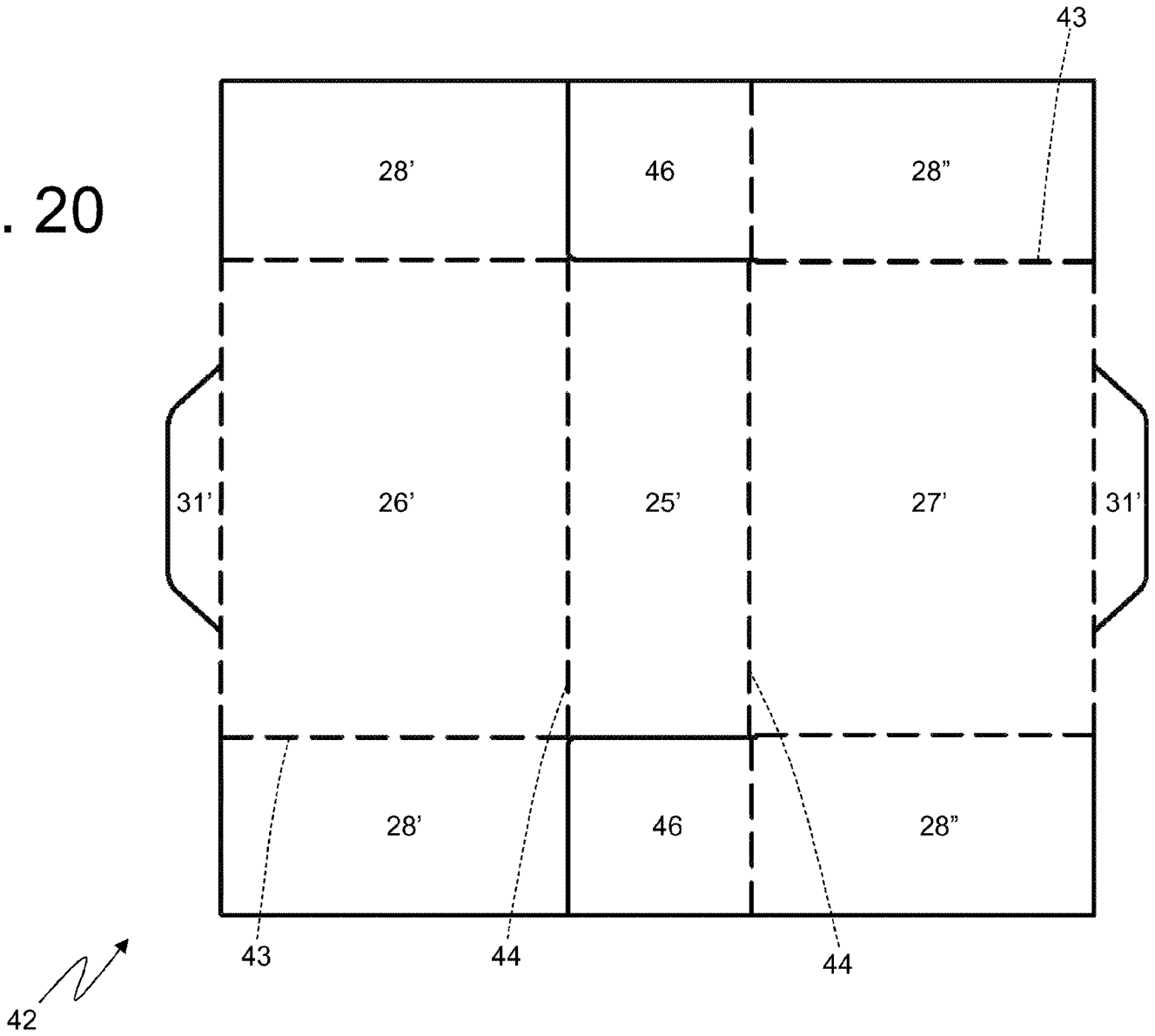
FIG. 20 is a plan view of a blank used to make a drawer of the pack of cigarettes of FIG. 16.

As illustrated in FIG. 20, the drawer 23 of the pack 1 of cigarettes illustrated in FIGS. 11-13 is obtained starting from a flat blank 42 which is almost identical to the flat blank 42 illustrated in FIG. 15, from which it differs only in the absence of the holes 47' and 47" which overlap one another to make up an access opening 47.

In the embodiments illustrated in the attached figures, the longitudinal and transverse edges are straight; alternatively, the longitudinal and/or transverse edges may be rounded or beveled.

The pack 1 of cigarettes described above has many advantages.

Firstly, the pack 1 of cigarettes described above, housing new-generation HeatStick cigarettes that are considerably shorter than traditional cigarettes, has a totally similar size to the size of a traditional pack of cigarettes; in this way, the handling (in particular the extraction of the cigarettes) of the pack 1 of cigarettes described above is easy and immediate for all users.

In addition, in the pack 1 of cigarettes described above, the space not used by the wrap 3 (containing the group of new-generation HeatStick cigarettes), namely the bottom chamber 18, is not useless (i.e. wasted) but is exploited as a usable container to house an accessory or to house the cigarettes already used and therefore exhausted. In particular, the access to the bottom chamber 18 is very simple and convenient thanks to the presence of the drawer 23 which can be easily opened and closed when needed.

The presence of drawer 23 that needs to be extracted so as to insert/pick up something also ensures that what is housed in drawer 23 does not fall out unintentionally e.g. when pack 1 of cigarettes is contained in the pocket of a suit or in a purse.

Finally, the pack 1 of cigarettes described above can easily be produced in a standard packing machine (which only needs a few changes of modest entity) and therefore the production thereof does not require the use of an expensive special packing machine (i.e. specially designed for this type of packs of cigarettes). This result is achieved in that the blanks 33 and 40 are completely similar to the corresponding traditional blanks and in that the drawer 23 can be assembled in advance and coupled to the blank 33 together with the wrap 3 (for example by exploiting the existing spaces for feeding coupons to feed the drawers 23 which are arranged beside the wraps 3 to form wrapping units 3/drawer 23 which are successively laid on the wraps 33).

It is important to point out that the pack 1 of cigarettes described above can advantageously be used to house tobacco articles of reduced height such as refill cartridges for electronic cigarettes, in addition to the aforementioned HeatStick cigarettes.

The invention claimed is:

1. A rigid pack (1) for tobacco articles comprising:

a group of tobacco articles;

a container (2), which houses the group of tobacco articles and comprises: a top opening, a front wall (6), a rear wall (8) opposite the front wall (6), and two side walls (7) opposite one another;

a lid (8), which comprises: a top wall (10), a front wall (11), a rear wall (12) opposite the front wall (11) and connected to the rear wall (6) of the container (2) and two side walls (13) opposite one another;

a drawer (23) which is mounted in a sliding manner in the container (2) between a closed position, in which the drawer (23) is completely arranged inside the container (2), and an open position in which the drawer (23) is partially pulled out of the container (2), projects outwards from the container (2) and is accessible from the outside;

a limit stop device (29), which fulfils the function of stopping the outward movement of the drawer (23) from the container (2), namely of preventing the drawer (23) from being completely pulled out of the container (2), thus establishing a maximum limit for the outward movement of the drawer (23) from the container (2); and a dividing wall (19), which is parallel to the top wall (10) of the lid (8) and divides the inner volume of the container (2) into a top chamber (17), which houses the group of tobacco articles, and a bottom chamber (18), which houses the drawer (23);

wherein the drawer (23) comprises: a bottom wall (25), a front wall (26), a rear wall (27) opposite the front wall (26) and two side walls (28) opposite one another;

the rigid pack (1) for tobacco articles is characterized in that:

the container (2) has a pull-out opening (24), which is opposite the top opening and through which the drawer (23) moves; and the drawer (23) moves longitudinally, namely with a moving direction that is perpendicular to the top wall (10) of the lid (8) and parallel to the side walls (7) of the container (2) and to the side walls (13) of the lid (8).

2. The rigid pack (1) for tobacco articles according to claim 1, wherein the limit stop device (29) comprises:

two first stopping tabs (30), each of which is connected, in the area of an edge of a pull-out opening (24), through which the drawer (23) moves, to a wall (7; 5, 6) of the container (2) and projects towards the inside of the container (2); and two second stopping tabs (31), each of which is connected to a wall (28; 26, 27) of the drawer (23) and projects towards the outside of the drawer (23).

3. The rigid pack (1) for tobacco articles according to claim 1 and comprising a rigid collar (14), which is folded in a "U"-shape, is arranged inside the container (2) so as to partially project outwards from the top end, and comprises: a front wall (15) and two side walls (16) opposite one another.

4. The rigid pack (1) for tobacco articles according to claim 3, wherein:

the collar (14) comprises the dividing wall (19) which is parallel to the top wall (10) of the lid (8) and divides the top chamber (17) from the bottom chamber (18);

the dividing wall (19) is connected to the front wall (15) of the collar (14) along a transverse folding line and is folded by 90° relative to the front wall (15) of the collar (14); and the dividing wall (19) is provided with a connection tab (20) which is connected to the dividing wall (19) along a transverse folding line, is folded by 90° relative to the dividing wall (19), and rests against as well as is glued to the rear wall (6) of the container (2).

5. The rigid pack (1) for tobacco articles according to claim 1, wherein:

the limit stop device (29) comprises: two first stopping tabs (30), each of which is connected, in the area of an edge of a pull-out opening (24), through which the drawer (23) moves, to a wall (7; 5, 6) of the container (2) and projects towards the inside of the container (2); and two second stopping tabs (31), each of which is connected to a wall (28; 26, 27) of the drawer (23) and projects towards the outside of the drawer (23);

the container (2) and the lid (8) are obtained by folding a blank (33) having a first panel (6') which makes up the rear wall (6) of the container (2) and a second panel (5'), which makes up the front wall (5) of the container (2);

in the blank (33) between the fourth panel (6') and the fifth panel (5'), two wings (30') are interposed, which make up the two first stopping tabs (30) and are each connected to a corresponding panel (5', 6') along a transverse folding line (35); and the two wings (30') making up the two first stopping tabs (30) are connected, at first, by a tearable line (47), which is torn during the folding of the blank (33) in order to separate the two wings (30').

6. The rigid pack (1) for tobacco articles according to claim 1, wherein a wall (28) of the drawer (23) has a first access opening (47), through which one can access the inside of the drawer (23).

7. The rigid pack (1) for tobacco articles according to claim 1, wherein a wall (7) of the container has a second access opening (49), through which one can access the inside of the drawer (23).

8. The rigid pack (1) for tobacco articles according to claim 1, wherein the drawer (23) comprises a top wall (45).

9. The rigid pack (1) for tobacco articles according to claim 1, wherein at least two walls (5, 6, 7) of the container (2) comprise respective claw-shaped holding recesses (32), which allow a user to get hold of the underlying walls (26, 27, 28) of the drawer (23).

10. The rigid pack (1) for tobacco articles according to claim 1, wherein the top chamber (17) and the bottom chamber (18) have the same volume, which is equal to half the total volume.

11. The rigid pack (1) for tobacco articles according to claim 1, wherein the tobacco articles are cigarettes consisting of a cylinder made of actual tobacco, which is suited to be heated by means of an electrical resistor so as to generate an aerosol.

* * * * *